US009257769B2

(12) United States Patent
Ito

(10) Patent No.: US 9,257,769 B2
(45) Date of Patent: Feb. 9, 2016

(54) CONTACT ELEMENT AND CONNECTOR

(75) Inventor: Yasukazu Ito, Tokyo (JP)

(73) Assignee: JAPAN AVIATION ELECTRONICS INDUSTRY, LIMITED, Shibuya-Ku, Tokyo (JP)

( * ) Notice: Subject to any disclaimer, the term of this patent is extended or adjusted under 35 U.S.C. 154(b) by 147 days.

(21) Appl. No.: 14/124,230

(22) PCT Filed: Feb. 7, 2012

(86) PCT No.: PCT/JP2012/052659
§ 371 (c)(1),
(2), (4) Date: Dec. 5, 2013

(87) PCT Pub. No.: WO2012/169223
PCT Pub. Date: Dec. 13, 2012

(65) Prior Publication Data

US 2014/0099843 A1 Apr. 10, 2014

(30) Foreign Application Priority Data

Jun. 7, 2011 (JP) ..... 2011-127017

(51) Int. Cl.
*H01R 13/33* (2006.01)
*H01R 13/02* (2006.01)
*H01R 13/187* (2006.01)

(52) U.S. Cl.
CPC ..... *H01R 13/02* (2013.01); *H01R 13/187* (2013.01)

(58) Field of Classification Search
CPC ..... H01R 13/187
USPC ..... 439/843, 827, 927, 845
See application file for complete search history.

(56) References Cited

U.S. PATENT DOCUMENTS

| | | | | | |
|---|---|---|---|---|---|
| 3,678,445 | A | * | 7/1972 | Brancaleone | 439/607.17 |
| 3,861,595 | A | * | 1/1975 | Deal | 439/436 |
| 4,013,329 | A | * | 3/1977 | Hugin | 439/33 |
| 4,061,413 | A | * | 12/1977 | Keller | 439/524 |
| 4,080,033 | A | * | 3/1978 | Deal | 439/816 |
| 4,191,445 | A | * | 3/1980 | Deal | 439/843 |

(Continued)

FOREIGN PATENT DOCUMENTS

| | | |
|---|---|---|
| JP | 52-101494 | 8/1977 |
| JP | 62-223994 | 10/1987 |

(Continued)

OTHER PUBLICATIONS

International Search Report (ISR) dated Apr. 24, 2012 (and English translation thereof) issued in International Application No. PCT/JP2012/052659.

*Primary Examiner* — Neil Abrams
(74) *Attorney, Agent, or Firm* — Holtz, Holtz & Volek PC

(57) ABSTRACT

A contact element capable of arranging beam portions at a narrower pitch and also facilitating insertion of a mating contact, and a connector have second and fourth contact portions which are displaced from each other in an orthogonal direction DR which is orthogonal to an arranging direction DP of first and second beam portions and a thickness direction DB of a linking portion. When a metal plate is blanked, the first and fourth contact portions are displaced from each other in a longitudinal direction L of the first and second beam portions, and the second and third contact portions are displaced from each other in the longitudinal direction L of the first and second beam portions.

21 Claims, 24 Drawing Sheets

(56) References Cited

U.S. PATENT DOCUMENTS

| | | | | | |
|---|---|---|---|---|---|
| 4,299,431 | A * | 11/1981 | Wilson et al. | 439/281 | |
| 4,512,623 | A * | 4/1985 | Tomsa | 439/607.17 | |
| 4,516,815 | A * | 5/1985 | Venable et al. | 439/95 | |
| 4,529,257 | A * | 7/1985 | Goodman et al. | 439/271 | |
| 4,750,897 | A * | 6/1988 | Neidecker | H01R 13/187 | 439/825 |
| 4,752,253 | A | 6/1988 | Neumann et al. | | |
| 4,874,337 | A * | 10/1989 | Paukovits et al. | 439/607.18 | |
| 5,052,948 | A * | 10/1991 | Hyzin | 439/607.01 | |
| 5,261,840 | A * | 11/1993 | Benz | H01R 4/4881 | 439/843 |
| 5,360,355 | A * | 11/1994 | Ehrler et al. | 439/816 | |
| 5,433,630 | A * | 7/1995 | Inaba et al. | 439/843 | |
| 6,296,519 | B1 * | 10/2001 | Hashizawa et al. | 439/607.42 | |
| 6,435,922 | B2 * | 8/2002 | Keiser et al. | 439/816 | |
| 6,547,607 | B2 * | 4/2003 | Moll et al. | 439/816 | |
| 8,038,488 | B2 * | 10/2011 | Mukuno | H01R 4/4881 | 439/845 |
| 8,057,269 | B2 * | 11/2011 | Ledermann et al. | 439/827 | |
| 8,128,441 | B2 * | 3/2012 | Mukuno | H01R 13/055 | 439/845 |
| 8,827,755 | B2 * | 9/2014 | Blakborn | H01R 13/113 | 439/845 |
| 2001/0019923 | A1 | 9/2001 | Moll et al. | | |
| 2003/0060090 | A1 * | 3/2003 | Allgood | H01R 11/289 | 439/845 |
| 2009/0029605 | A1 | 1/2009 | Matsumoto et al. | | |
| 2011/0045712 | A1 | 2/2011 | Mukumo | | |
| 2014/0099843 | A1 * | 4/2014 | Ito | 439/884 | |

FOREIGN PATENT DOCUMENTS

| | | |
|---|---|---|
| JP | 2001-250625 | 9/2001 |
| JP | 2011-044256 | 3/2011 |
| WO | WO 2007/066701 | 6/2007 |

* cited by examiner

CONTACT ELEMENT AND CONNECTOR

TECHNICAL FIELD

The present invention relates to a contact element and a connector comprising the contact element.

BACKGROUND ART

Conventionally, there has been known a connector comprising contact elements and a base contact (see Patent Literature 1).

The above-mentioned connector comprises one base contact 62 and two contact elements 63, as shown in FIG. 23.

The base contact 62 is formed of a conductive material. The base contact 62 is formed with a groove 62*a*. A base contact 61 formed of a conductive material is inserted into the groove 62*a*. Inner wall surfaces of the base contact 62, opposed to each other, are each formed with a groove 62*c*. The groove 62*c* is a dovetail groove.

As shown in FIG. 24, each contact element 63 includes side portions 3*a* formed in two rows, which extend parallel to each other, and a plurality of webs 3*c* each extend in a manner bridging between the side portions 3*a*. Each contact element 63 is formed by pressworking one metal plate having elasticity.

Each web 3*c* is formed with one protruding portion 3*i* at one side of a central portion 3*f* thereof, and is formed with one recess 3*m* in the other side of the central portion 3*f* thereof. Two web edges 3*k* are formed on both sides of the recess 3*m*. Each web 3*c* is twisted, whereby the protruding portion 3*i* protrudes in a thickness direction of the side portion 3*a*, and each web edge 3*k* protrudes in a direction opposite to a protruding direction of the protruding portion 3*i*. The protruding portion 3*i* is capable of contacting the base contact 61, and the web edges 3*k* are capable of contacting the base contact 62.

Before the web 3*c* is twisted, the protruding portion 3*i* is fitted in the recess 3*m* of an adjacent web 3*c*, and is sandwiched between the two web edges 3*k*.

The contact elements 63 are fitted in the grooves 62*c* of the base contact 62, respectively. At this time, the web edges 3*k* of each contact element 63 is in contact with the base contact 62.

As shown in FIG. 23, when the base contact 61 is inserted into the groove 62*a* of the base contact 62, the protruding portions 3*i* of the contact elements 63 are in contact with the base contact 61. As a result, the base contact 61 and the base contact 62 are electrically connected via the contact elements 63.

As described above, since this contact element 63 employs the arrangement in which the protruding portion 3*i* is fitted in the recess 3*m* before each web 3*c* is twisted, it is possible to arrange the webs 3*c* at a reduced pitch, and as a result, it is possible to increase the numbers of protruding portions 3*i* and web edges 3*k* per unit length, which makes it possible to cause a large amount of electric current to flow.

CITATION LIST

Patent Literature

[PTL 1]: U.S. Pat. No. 5,261,840

SUMMARY OF THE INVENTION

Technical Problem

However, in the conventional contact element 63, since the plurality of protruding portions 3*i* are arranged in one row in an arranging direction of the webs 3*c*, when the base contact 61 is inserted into the groove 62*a* of the base contact 62, the base contact 61 has the plurality of protruding portions 3*i* simultaneously brought into contact therewith, and hence a large insertion force is required to insert the base contact 61 to the depth of the groove 62*a*.

The present invention has been made in view of these circumstances, and an object thereof is to provide a contact element which is capable of not only arranging the beam portions at a narrower pitch, but also facilitating insertion of a mating connector, and a connector.

Solution of Problem

To attain the object, the present invention is a contact element that is formed by pressworking a metal plate, and is mounted on a contact, comprising a plurality of linking portions that extend parallel to each other with a fixed spacing therebetween, first and second beam portions that extend in a manner bridging between the linking portions, and are arranged at a predetermined pitch in an alternating manner, a first contact portion that is continuous with the first beam portion, and is brought into contact with the contact, a second contact portion that is continuous with the first beam portion, and is brought into contact with a mating contact to which the contact is connected, a third contact portion that is continuous with the second beam portion, and is brought into contact with the contact, and a fourth contact portion that is continuous with the second beam portion, and is brought into contact with the mating contact, wherein the first and third contact portions protrude in a first direction parallel to an arranging direction of the first and second beam portions, wherein the second and fourth contact portions protrude in a second direction opposite to the first direction, wherein the first and second beam portions are twisted, whereby the first and third contact portions protrude in a third direction parallel to a thickness direction of the linking portions, and the second and fourth contact portions protrude in a fourth direction opposite to the third direction, wherein the second and fourth contact portions are displaced from each other in an orthogonal direction orthogonal to the arranging direction and the thickness direction, wherein when the metal plate is blanked, the first and fourth contact portions are displaced from each other in a longitudinal direction of the first and second beam portions, and wherein when the metal plate is blanked, the second and third contact portions are displaced from each other in the longitudinal direction of the first and second beam portions.

Preferably, when the metal plate is blanked, the first and fourth contact portions are side by side along a direction parallel to the longitudinal direction of the first and second beam portions, and when the metal plate is blanked, the second and third contact portions are side by side along the direction parallel to the longitudinal direction of the first and second beam portions.

Preferably, the first contact portion and the second contact portion which are continuous with the first beam portion are each provided in number of one, and the third contact portion and the fourth contact portion which are continuous with the second beam portion are each provided in number of one.

Preferably, the first contact portion and the second contact portion which are continuous with the first beam portion are each provided in number of one, the third contact portion and the fourth contact portion which are continuous with the second beam portion are each provided in number of two, the fourth contact portions are located on opposite sides of the first contact portion, and the third contact portions are located on opposite sides of the second contact portion.

Preferably, the second and fourth contact portions each have a slit formed in a rear end portion thereof, which extends in the longitudinal direction of the first and second beam portions.

Preferably, the fourth contact portion has a slit formed in a rear end portion thereof, which extends in the longitudinal direction of the first and second beam portions.

Preferably, front end portions of the first to fourth contact portions are each arcuately bent.

The present invention is a contact element that is formed by pressworking a metal plate, and is mounted on a contact, comprising a plurality of linking portions that extend parallel to each other with a fixed spacing therebetween, first, second, and third beam portions that extend in a manner bridging between the linking portions, and are arranged at a predetermined pitch and in a predetermined order, a first contact portion that is continuous with the first beam portion, and is brought into contact with the contact, a second contact portion that is continuous with the first beam portion, and is brought into contact with a mating contact to which the contact is connected, a third contact portion that is continuous with the second beam portion, and is brought into contact with the contact, a fourth contact portion that is continuous with the second beam portion, and is brought into contact with the mating contact, a fifth contact portion which is continuous with the third beam portion, and is brought into contact with the contact, and a sixth contact portion which is continuous with the third beam portion, and is brought into contact with the mating contact, wherein the first, third, and fifth contact portions protrude in a first direction parallel to an arranging direction of the first, second, and third beam portions, wherein the second, fourth, and sixth contact portions protrude in a second direction opposite to the first direction, wherein the first, second, and third beam portions are twisted, whereby the first, third, and fifth contact portions protrude in a third direction parallel to a thickness direction of the linking portions, and the second, fourth, and sixth contact portions protrude in a fourth direction opposite to the third direction, wherein the second, fourth, and sixth contact portions are displaced from each other in an orthogonal direction orthogonal to the arranging direction and the thickness direction, wherein when the metal plate is blanked, the first, third, and fifth contact portions are displaced from each other in a longitudinal direction of the first, second, and third beam portions, and wherein when the metal plate is blanked, the second, fourth, sixth contact portions are displaced from each other in the longitudinal direction of the first, second, and third beam portions.

Preferably, when the metal plate is blanked, the first and sixth contact portions are side by side along a direction parallel to the longitudinal direction of the first and third beam portions, when the metal plate is blanked, the second and third contact portions are side by side along a direction parallel to the longitudinal direction of the first and second beam portions, and when the metal plate is blanked, the fourth and fifth contact portions are side by side along a direction parallel to the longitudinal direction of the second and third beam portions.

Preferably, the first contact portion and the second contact portion which are continuous with the first beam portion are each provided in number of one, the third contact portion and the fourth contact portion which are continuous with the second beam portion are each provided in number of one, and the fifth contact portion and the sixth contact portion which are continuous with the third beam portion are each provided in number of one.

Preferably, the second and sixth contact portions each have a slit formed in a rear end portion thereof, which extends in the longitudinal direction of the first and third beam portions.

Preferably, front end portions of the first to sixth contact portions are each arcuately bent.

The present invention provides a connector comprising the contact element and the contact on which the contact element is mounted.

Effects of the Invention

According to the present invention, it is possible not only to arrange the beam portions at a narrower pitch but also to facilitate insertion of a mating connector.

BEST MODE FOR CARRYING OUT THE INVENTION

Hereafter, an embodiment of the present invention will be described with reference to the drawings.

Figure 1:
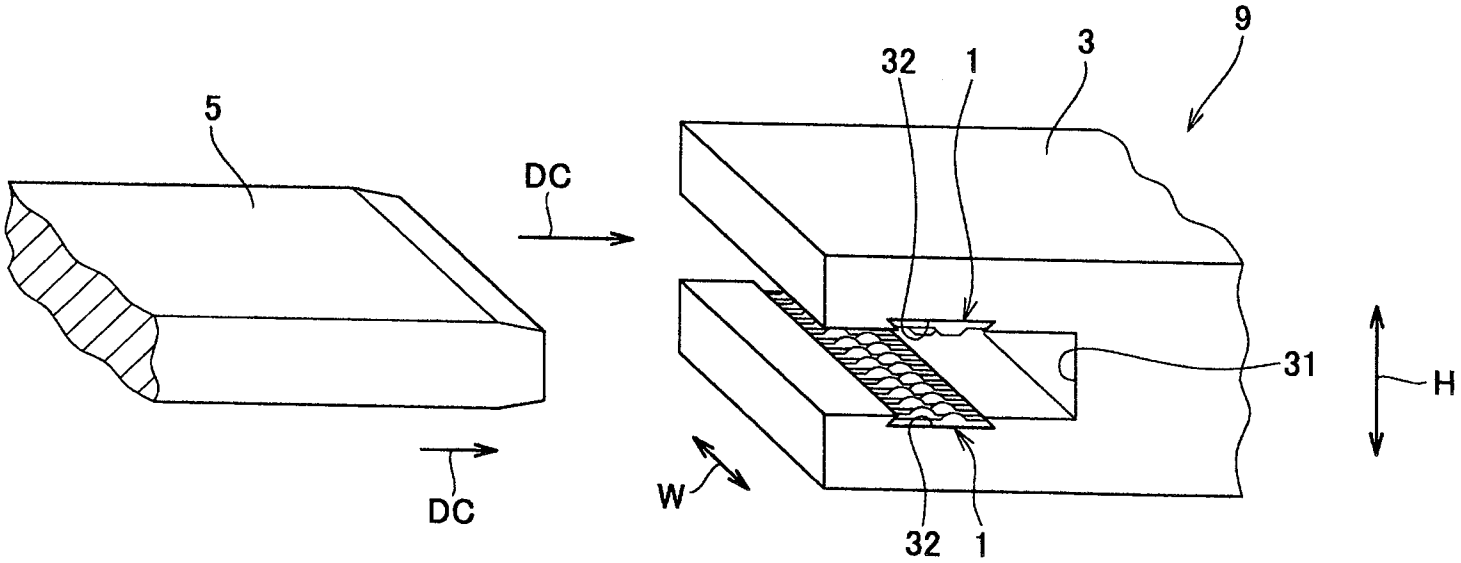
FIG. 1 is a perspective view showing a state before a mating contact is inserted into a contact of a connector according to a first embodiment of the present invention.

As shown in FIG. 1, a connector 9 according to a first embodiment of the present invention comprises two contact elements 1 and one contact 3.

The contact 3 is formed of a conductive material, and has a receiving portion 31. The receiving portion 31 receives a plate-shaped contact (mating contact) 5. The receiving portion 31 is open toward the front side and opposite sides of the contact 3. Two inner wall surfaces of the contact 3, opposed to each other (opposed in a height direction H) across the receiving portion 31, are each formed with a dovetail groove 32. The dovetail groove 32 extends in a width direction W of the contact 3.

Figure 2:
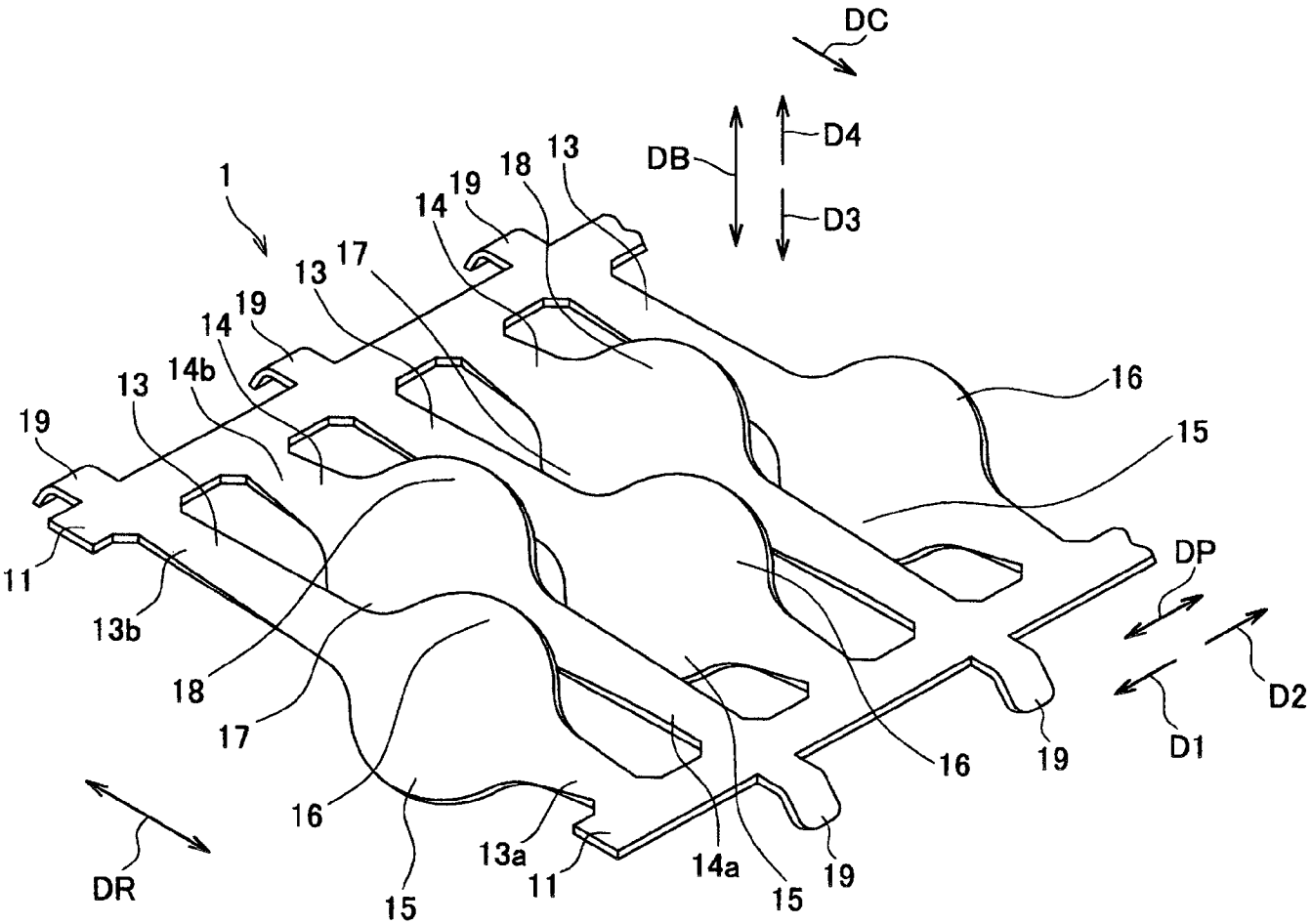
FIG. 2 is a perspective view of part of a contact element of the connector shown in FIG. 1.
Figure 3:
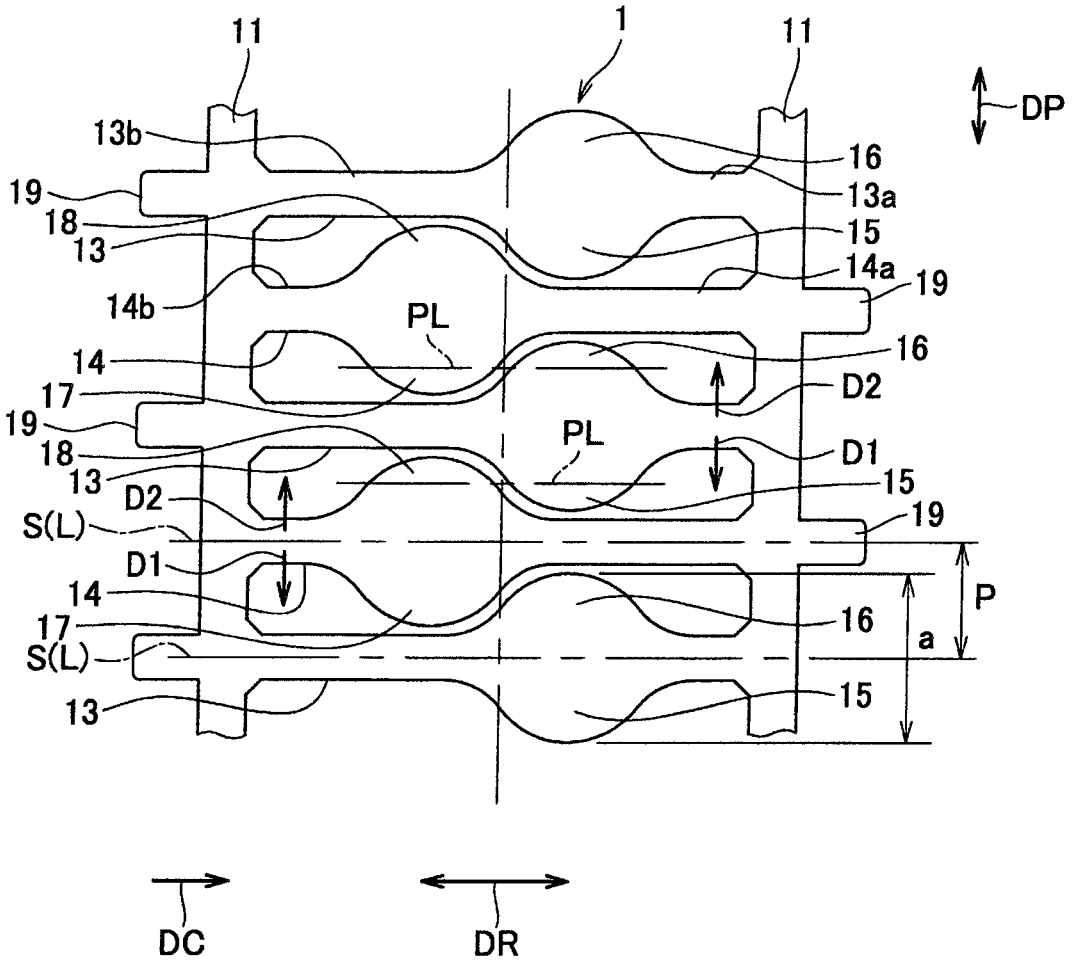
FIG. 3 is a plan view of the contact element when blanked.

The contact elements 1 are inserted in the dovetail grooves 32 from the width direction W of the contact 3, respectively. As shown in FIGS. 2 and 3, each contact element 1 includes two linking portions 11, a plurality of first beam portions 13, and a plurality of second beam portions 14. In FIGS. 2 and 3, only three of a number of first beam portions 13 are illustrated. Also, only two of a number of second beam portions 14 are illustrated. Each contact element 1 is formed by press-working, such as blanking and bending, on a metal plate having elasticity and conductivity.

The two linking portions 11 extend parallel to each other with a fixed spacing therebetween.

The plurality of first beam portions 13 each have a substantially belt-like shape, and are each extend in a manner bridging between the two linking portions 11. The plurality of second beam portions 14 each have a substantially belt-like shape, and are each extend in a manner bridging between the two linking portions 11. The first and second beam portions 13 and 14 are arranged in an alternating manner at a predetermined pitch P (see FIG. 3).

A first contact portion 15 which is brought into contact with the contact 3 is continuous with the first beam portion 13. The first contact portion 15 is at a location displaced from the center of each first beam portion 13 toward one of the linking portions 11 (right-side linking portion 11 as viewed in FIG. 3).

A second contact portion 16 which is brought into contact with the contact 5 is continuous with the first beam portion 13. The second contact portion 16 is at a location displaced from the center of the first beam portion 13 toward the one of the linking portions 11.

The first contact portion 15 protrudes from the first beam portion 13 in a first direction D1 (see FIG. 3) parallel to an arranging direction DP of the first beam portions 13 and the second beam portions 14.

The second contact portion 16 protrudes from the first beam portion 13 in a second direction D2 (see FIG. 3) opposite to the first direction D1.

A third contact portion 17 which is brought into contact with the contact 3 is continuous with the second beam portion 14. The third contact portion 17 is at a location displaced from the center of the second beam portion 14 toward the other of the linking portions 11 (left-side linking portion 11 as viewed in FIG. 3).

A fourth contact portion 18 which is brought into contact with the contact 5 is continuous with the second beam portion 14. The fourth contact portion 18 is at a location displaced from the center of the second beam portion 14 toward the other of the linking portions 11.

The third contact portion 17 protrudes from the second beam portion 14 in the first direction D1 (see FIG. 3).

The fourth contact portion 18 protrudes from the second beam portion 14 in the second direction D2 (see FIG. 3).

As shown in FIG. 2, each of the first beam portions 13 is twisted around a central axis S (see FIG. 3) parallel to a longitudinal direction L thereof, whereby the first contact portion 15 protrudes in a third direction D3 parallel to a thickness direction DB of the linking portion 11, and the second contact portion 16 protrudes in a fourth direction D4 opposite to the direction D3.

As shown in FIG. 2, each of the second beam portions 14 is twisted around the central axis S (see FIG. 3) parallel to a longitudinal direction L thereof, whereby the third contact portion 17 protrudes in the third direction D3, and the fourth contact portion 18 protrudes in the fourth direction D4. In the present embodiment, the central axis S of each of the first and second beam portions 13 and 14 is parallel to an orthogonal direction DR, described hereinafter.

As shown in FIG. 2, the second contact portion 16 and the fourth contact portion 18 of the second beam portion 14 which is adjacent to this second contact portion 16 are displaced from each other in the orthogonal direction DR which is orthogonal to the arranging direction DP and the thickness direction DB.

As shown in FIG. 3, the first contact portion 15 and the second contact portion 16 are symmetric with respect to the central axis S of the first beam portion 13. Similarly, the third contact portion 17 and the fourth contact portion 18 are symmetric with respect to the central axis S of the second beam portion 14.

A plurality of protrusion-like held portions 19 are continuous with each linking portion 11.

As shown in FIG. 3, when a metal plate has been blanked, the first contact portion 15 and the fourth contact portion 18 of the second beam portion 14 adjacent to this contact portion 15 are side by side along a direction PL parallel to the longitudinal direction L of each of the first and second beam portions 13 and 14, and the second contact portion 16 and the third contact portion 17 of the second beam portion 14 adjacent to this contact portion 16 are side by side along the direction PL parallel to the longitudinal direction L of each of the first and second beam portions 13 and 14. At this time, the pitch P between the first and second beam portions 13 and 14 is smaller than a distance "a" between a front edge of the first contact portion 15 and a front edge of the second contact portion 16 (distance in the arranging direction DP) or a distance (equal to the distance "a") between a front edge of the third contact portion 17 and a front edge of the fourth contact portion 18. Therefore, it is possible to realize a narrower pitch between the first and second beam portions 13 and 14, which makes it possible to increase the number of the first and second beam portions 13 and 14 without increasing the dimension of the contact element 1 in the arranging direction DP.

As described above, the first contact portion 15 and the second contact portion 16 which are continuous with one first beam portion 13 are each provided in number of one, and the third contact portion 17 and the fourth contact portion 18 which are continuous with the one second beam portion 14 are each provided in number of one.

To form the contact element 1, first, as shown in FIG. 3, a metal plate is blanked.

Next, the first beam portions 13 and the second beam portions 14 are each twisted around the central axis S.

Finally, the held portions 19 are each bent into a substantially L-shape.

By the above-described steps, the contact element 1 is formed.

The above-mentioned steps of presswork is executed in such a manner that first, a metal plate is blanked, next, the first beam portions 13 and the second beam portions 14 are twisted, and finally, the held portions 19 are bent, but the order of the steps of presswork for the contact element 1 is not limited to this. For example, the steps may be executed in such a manner that first, a metal plate is blanked, next, the held portions 19 are bent, and finally, the first beam portions 13 and the second beam portions 14 are each twisted around the central axis S.

To assemble the connector 9, as shown in FIG. 1, it is only necessary to insert the two contact elements 1 into the two dovetail grooves 32 of the contact 3, respectively. When each contact element 1 has been inserted into an associated one of the dovetail grooves 32, the held portions 19 are fitted in the opposite side portions of the dovetail groove 32, whereby the contact element 1 is held by the contact 3. At this time, the first contact portions 15 and the third contact portions 17 are brought into contact with the contact 3.

To connect the contact 5 to the connector 9, as shown in FIG. 1, it is only necessary to insert the contact 5 into the receiving portion 31 of the contact 3 from a fitting direction DC. At this time, the insertion force increases when the front end portion of the contact 3 is bought into abutment with the fourth contact portions 18, and then decreases when the front end portion of the contact 3 is slid onto the fourth contact portions 18. Then, the insertion force increases again when the front end portion of the contact 3 is bought into abutment with the second contact portions 16, and then decreases again when the front end portion of the contact 3 is slid onto the second contact portions 16. Since the second contact portions 16 and the fourth contact portions 18 are displaced from each other in the orthogonal direction DR, the peak of the insertion force is dispersed, whereby the maximum value of the insertion force becomes small.

When the contact 5 has been inserted into the receiving portion 31, the second contact portions 16 and the fourth contact portions 18 of the contact element 1 are in contact with the contact 5.

Since the first contact portion 15 and the second contact portion 16 which are continuous with one first beam portion 13 are each provided in number of one, and the third contact portion 17 and the fourth contact portion 18 which are continuous with one second beam portion 14 are each provided in number of one, this prevents the contact force between the contact portions 16 and 18 and the contact 5 generated when the contact 5 is inserted into the receiving portion 31 of the contact 3 from becoming excessively large, and hence this prevents the insertion force of the contact 5 from becoming large.

According to the present embodiment, it is possible to facilitate insertion of the contact 5.

Further, when a metal plate has been blanked, the first contact portion 15 and the fourth contact portion 18 of the second beam portion 14 adjacent to this first contact portion 15 are side by side along the direction PL parallel to the longitudinal direction L, and the second contact portion 16 and the third contact portion 17 of the second beam portion 14 adjacent to this second contact portion 16 are side by side along the direction PL parallel to the longitudinal direction L, and hence it is possible to realize a narrower pitch of the first beam portions 13 and the second beam portions 14 as described above, which makes it possible to increase the number of the first beam portions 13 and the second beam portions 14 without increasing the dimension of the contact element 1 in the arranging direction DP, whereby it is possible to cause a large amount of electric current to flow.

Figure 4:
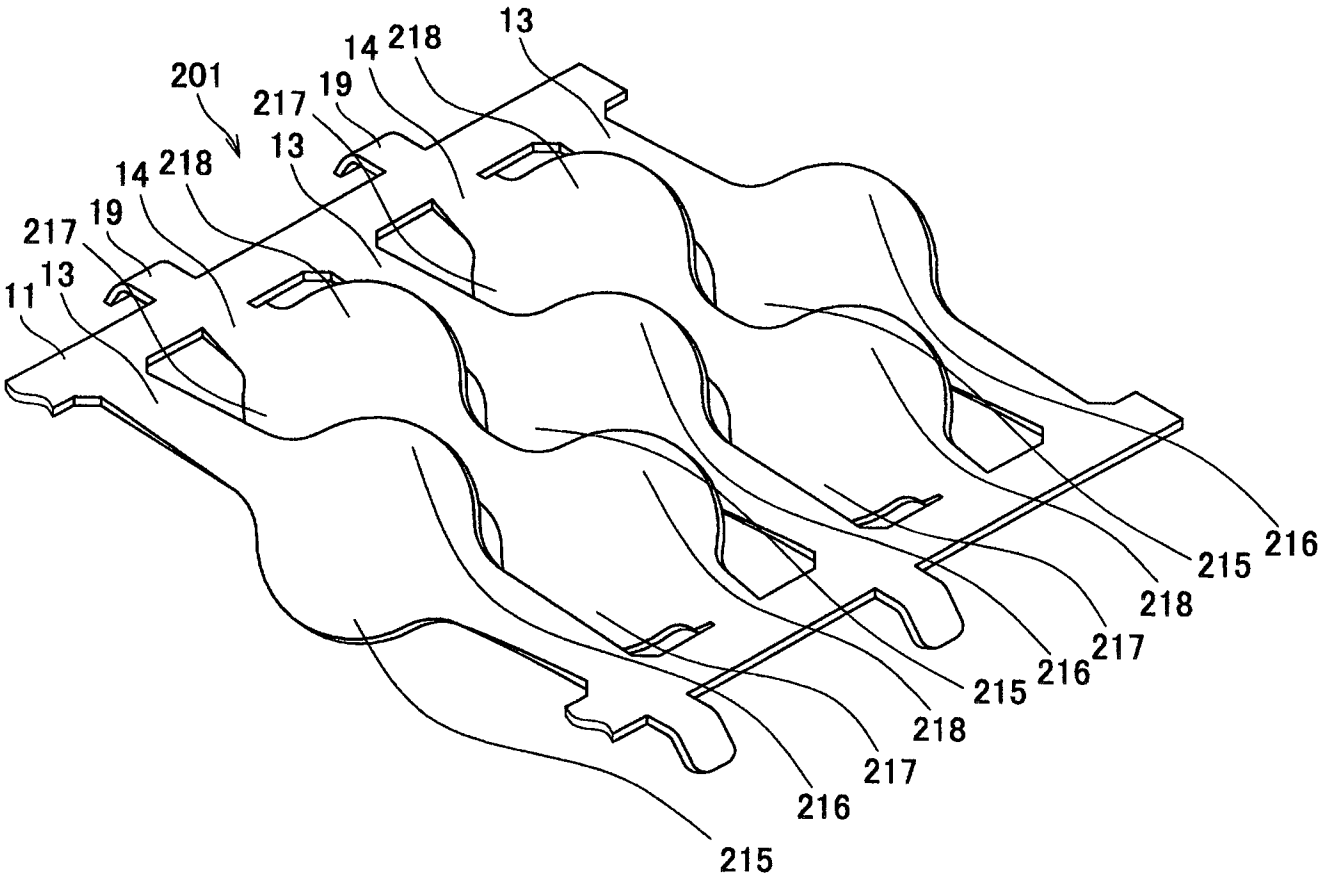
FIG. 4 is a perspective view of part of a contact element of a connector according to a second embodiment of the present invention.

Next, a description will be given of a contact element according to a second embodiment of the present invention with reference to FIGS. 4 and 5. Component parts identical to those of the contact element according to the first embodiment are denoted by the same reference numerals, and detailed description thereof is omitted. The following description will be given of only different parts from those of the first embodiment.

In the contact element 1 according to the first embodiment, the first contact portion 15 and the second contact portion 16 which are continuous with one first beam portion 13 are each provided in number of one, and the third contact portion 17 and the fourth contact portion 18 which are continuous with one second beam portion 14 are each provided in number of one. On the other hand, in the contact element, denoted by reference numeral 201, according to a second embodiment, the first contact portion 215 and the second contact portion 216 which are continuous with one first beam portion 13 are each provided in number of one, and third contact portions 217 and fourth contact portions 218 which are continuous with one second beam portion 14 are each provided in number of two.

Figure 5:
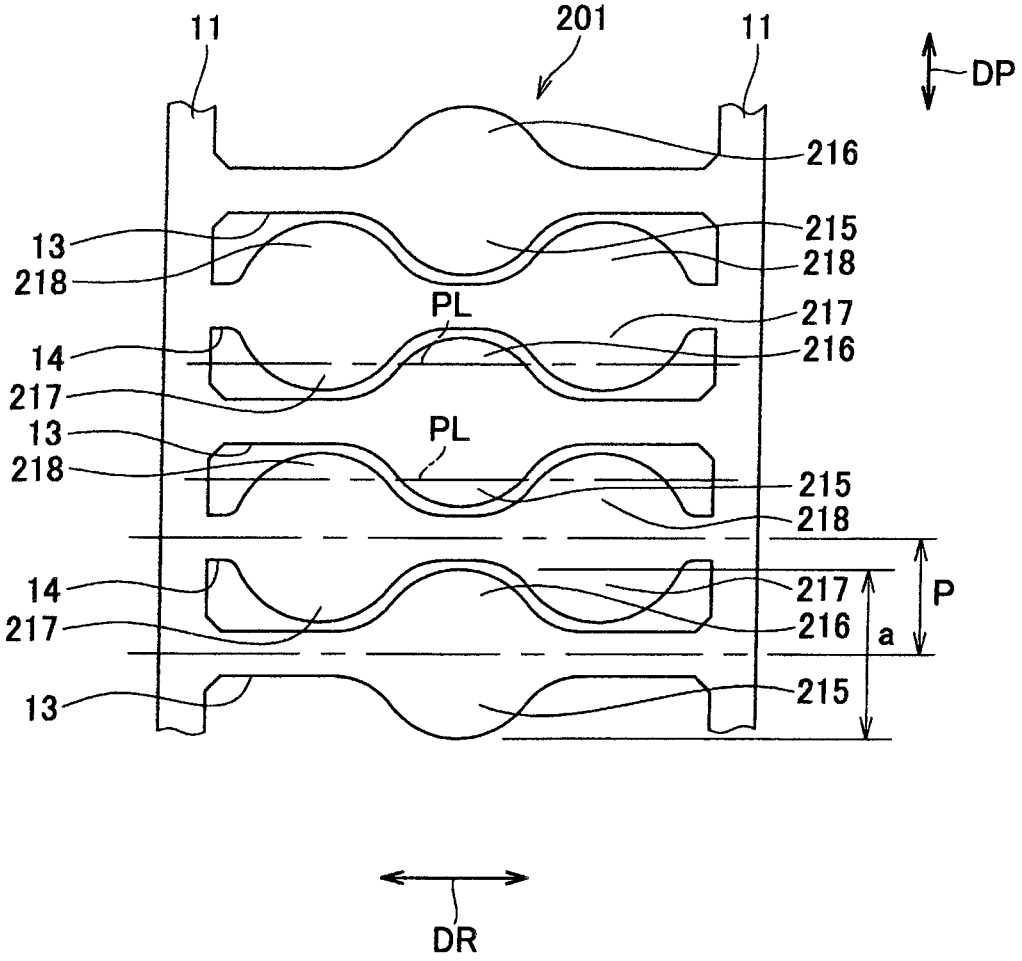
FIG. 5 is a plan view of the contact element when blanked.

As shown in FIG. 5, when a metal plate has been blanked, the second contact portions 216 and the fourth contact portions 218 are displaced from each other in the orthogonal direction DR. Further, the first contact portion 215 and the fourth contact portions 218 of the second beam portion 14 adjacent to this first contact portion 215 in the arranging direction DP are side by side along the direction PL parallel to the longitudinal direction L. The fourth contact portions 218 are located on opposite sides of the first contact portion 215 in the direction PL parallel to the longitudinal direction L. The second contact portion 216 and the third contact portions 217 of the second beam portion 14 adjacent to this second contact portion 216 in the arranging direction DP are side by side along the direction PL parallel to the longitudinal direction L. The third contact portions 217 are located on opposite sides of the second contact portion 216 in the direction PL parallel to the longitudinal direction L.

According to the second embodiment, it is possible to obtain the same advantageous effects as provided by the first embodiment, and since the number of contact portions is increased, it is possible to cause a larger amount of electric current to flow.

Next, a description will be given of a contact element 301 according to a third embodiment of the present invention with reference to FIGS. 6 and 7. Component parts identical to those of the contact element according to the first embodiment are denoted by the same reference numerals, and detailed description thereof is omitted. The following description will be given of only different parts from those of the first embodiment.

Figure 6:
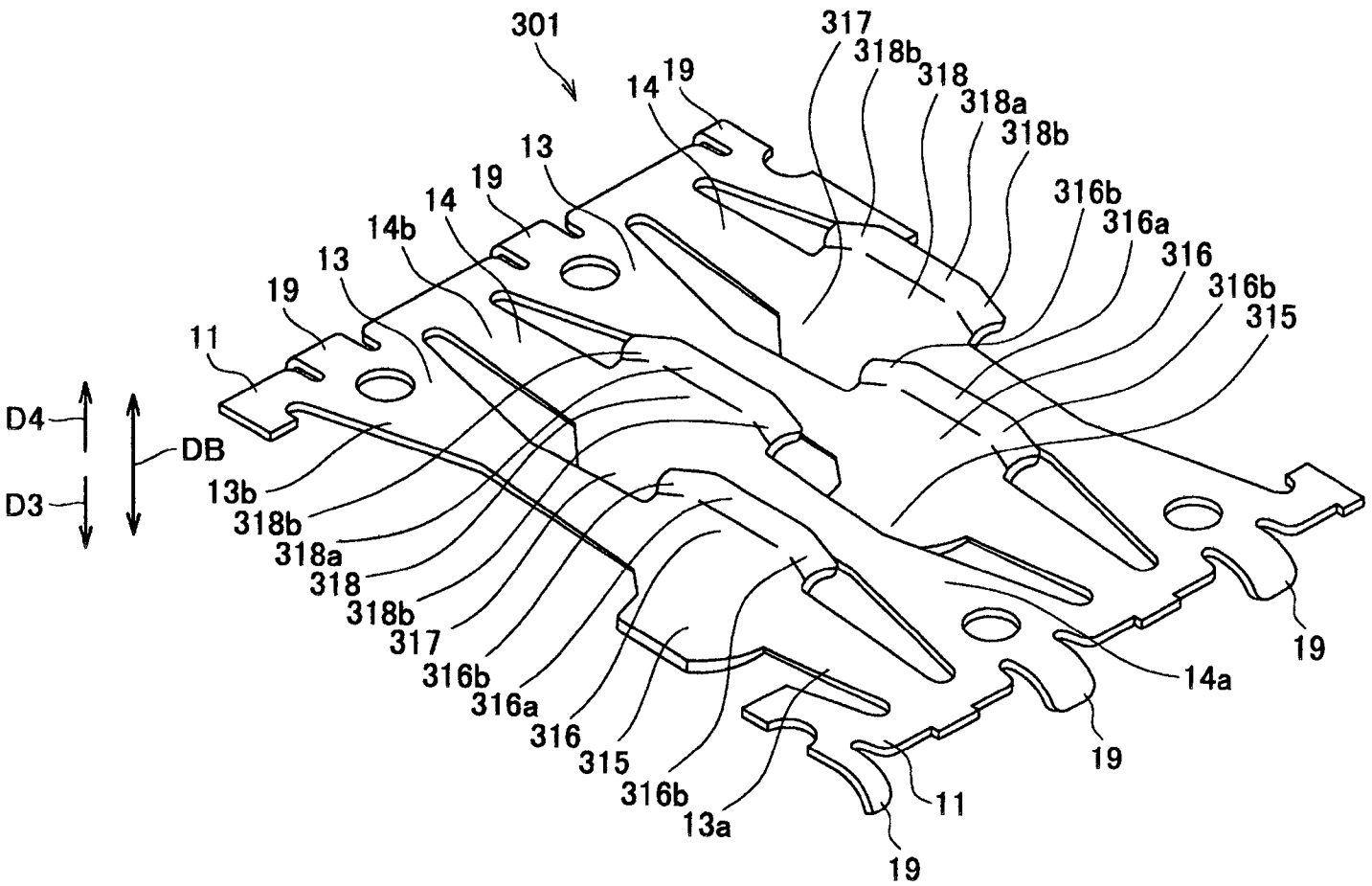
FIG. 6 is a perspective view of part of a contact element of a connector according to a third embodiment of the present invention.
Figure 7:
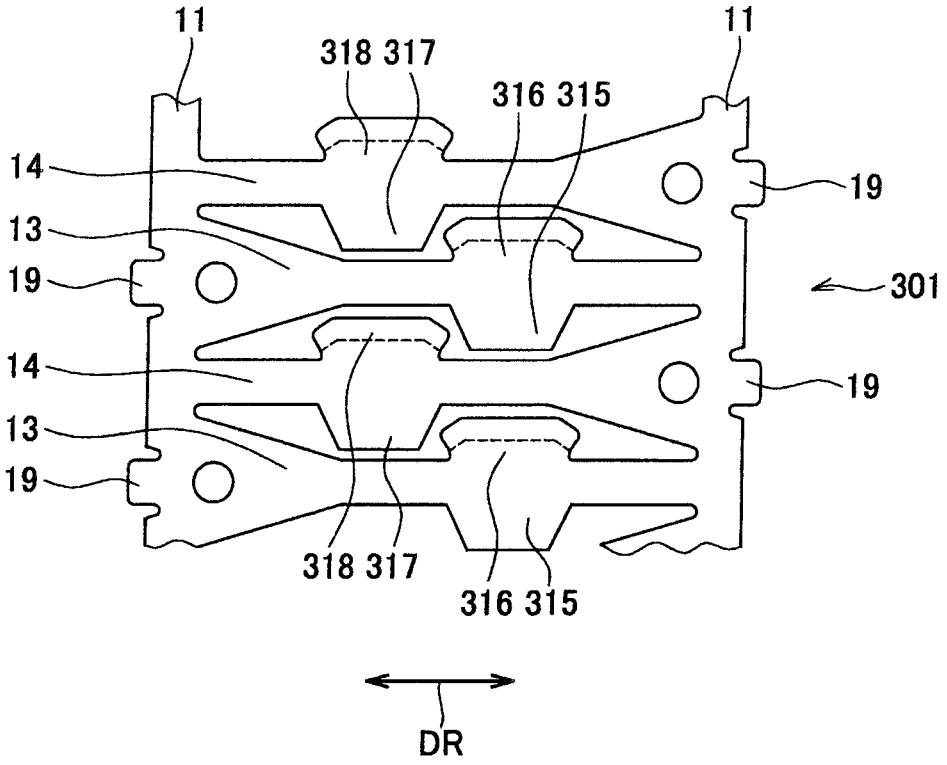
FIG. 7 is a plan view of the contact element when blanked.

As shown in FIGS. 6 and 7, front end portions of a first contact portion 315 and a second contact portion 316 are each arcuately bent.

A contact point portion **316*a* is located on a central portion of the front end portion of the second contact portion 316, and guiding portions 316*b* are located on opposite sides of the contact point portion 316*a*. One of the guiding portions 316*b* gradually slopes toward one of the linking portions 11, and the other of the guiding portions 316*b* gradually slopes toward the other of the linking portions 11**.

Front end portions of a third contact portion 317 and a fourth contact portion 318 are each arcuately bent.

A contact point portion 318*a* is located on a central portion of the front end portion of the fourth contact portion 318, and guiding portions 318*b* are located on opposite sides of the contact point portion 318*a*. One of the guiding portions 318*b* gradually slopes toward one of the linking portions 11, and the other of the guiding portions 318*b* gradually slopes toward the other of the linking portions 11.

According to the third embodiment, it is possible to obtain the same advantageous effects as provided by the first embodiment, and when a mating contact (not shown) is inserted, the mating contact is easily slid onto the contact point portions 316*a* and 318*a* by the guiding portions 316*b* and 318*b*, and hence it is possible to further facilitate insertion of the mating contact.

Figure 8:
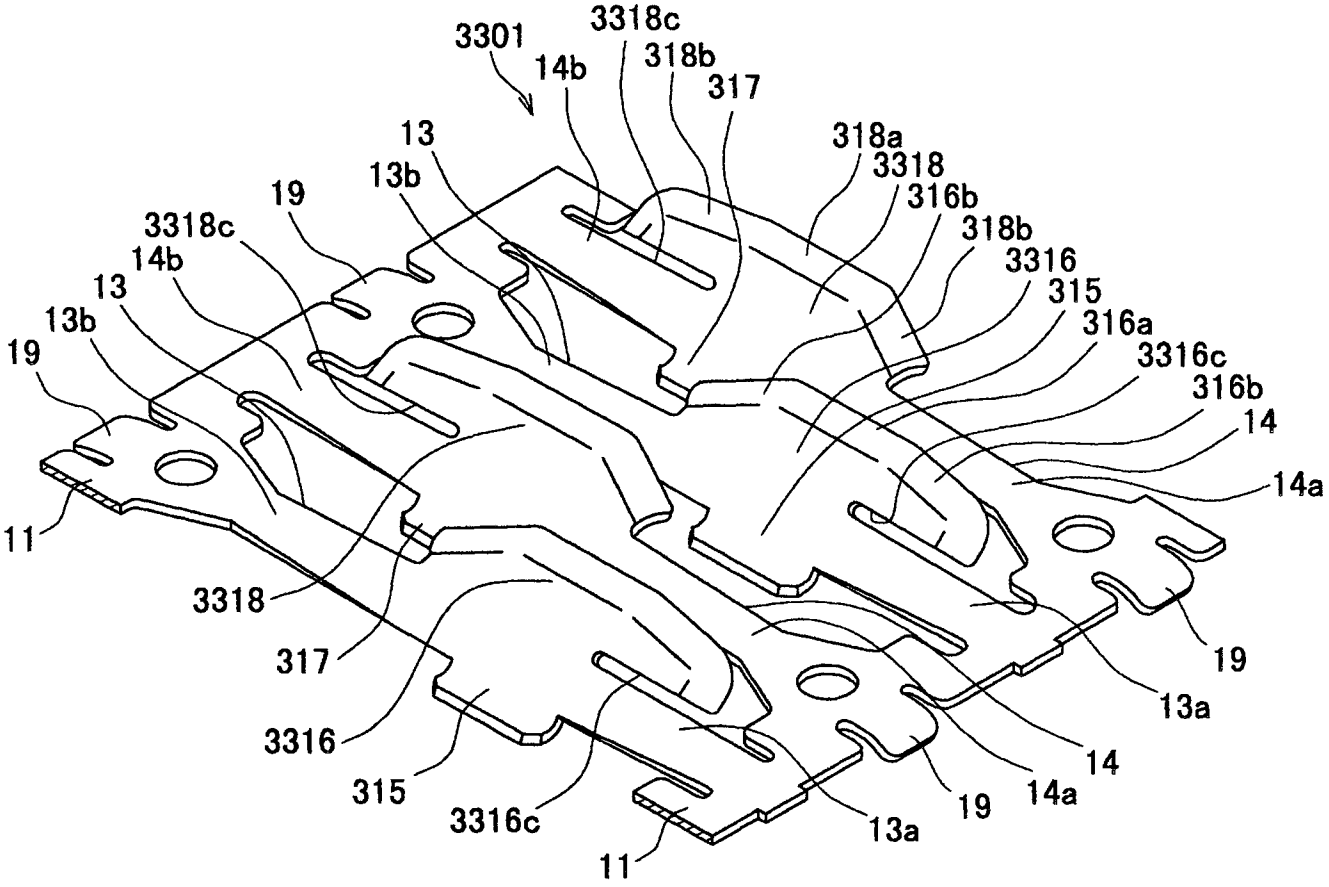
FIG. 8 is a perspective view of part of a contact element of a variation of the third embodiment of the present invention.
Figure 9:
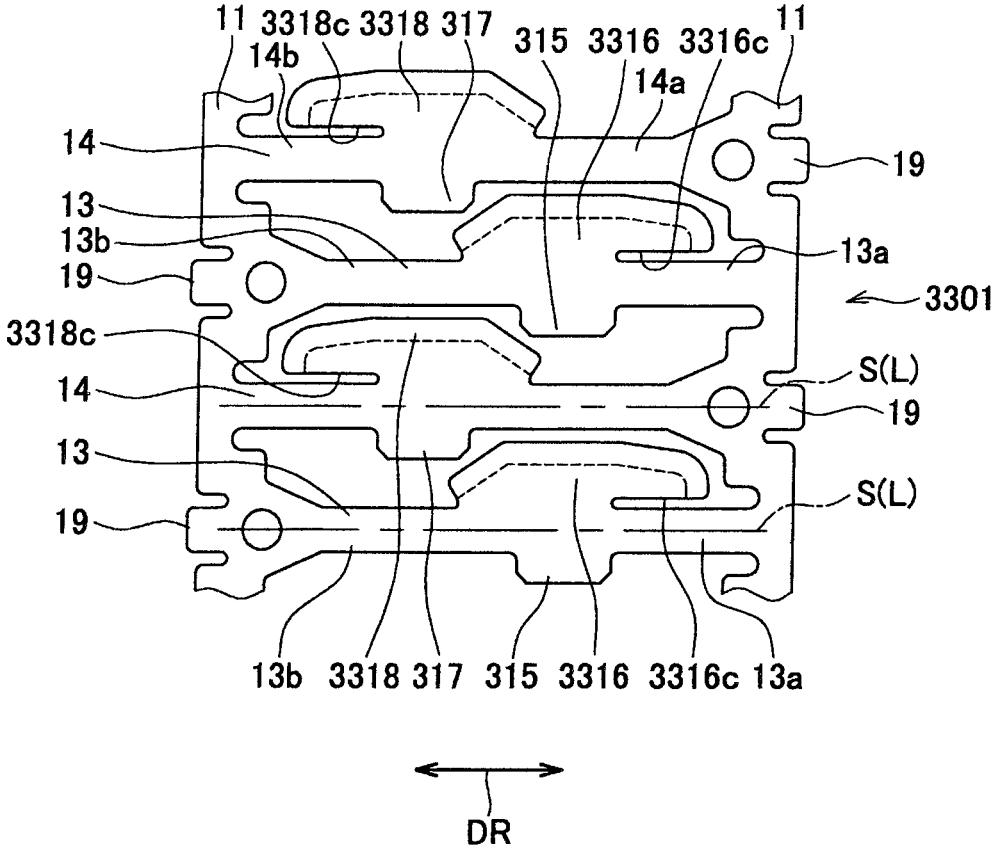
FIG. 9 is a plan view of the contact element when blanked.

Next, a description will be given of a contact element 3301 according to a variation of the third embodiment of the present invention with reference to FIGS. 8 and 9. Component parts identical to those of the contact element according to the first and third embodiments are denoted by the same reference numerals, and detailed description thereof is omitted. The following description will be given of only different parts from those of the first and third embodiments.

In the contact element 3301 according to the variation, a second contact portion 3316 is extended in the longitudinal direction L (see FIG. 9), and is formed with a slit 3316*c* in a rear end portion thereof (portion close to a rear end in a protruding direction of the second contact portion 3316). By extending the second contact portion 3316 in the longitudinal direction L and increasing the length of each of the guiding portions 316*b* on the opposite sides of the contact point portion 316*a*, it is made possible to more easily insert the mating contact. Further, by forming the slit 3316*c* in the second contact portion 3316 and increasing the length of one twisted portion 13*a* of the first beam portion 13, a spring constant of the twisted portion 13*a* is reduced. In the present variation, the one twisted portion 13*a* and the other twisted portion 13*b* have substantially the same length.

Similarly, a fourth contact portion 3318 is extended in the longitudinal direction L, and is formed with a slit 3318*c* in a rear end portion thereof. By extending the fourth contact portion 3318 in the longitudinal direction L and increasing the length of each of the guiding portions 318*b* on the opposite sides of the contact point portion 318*a*, it is made possible to more easily insert the mating contact. Further, by forming the slit 3318*c* in the fourth contact portion 3318 and increasing the length of one twisted portion 14*a* of the second beam portion 14, a spring constant of the twisted portion 14*b* is reduced. In the present variation, the one twisted portion 14*b* and the other twisted portion 14*a* have substantially the same length.

According to the variation of the third embodiment, it is possible to obtain the same advantageous effects as provided by the first and third embodiments, and it is possible to increase the length of each of the twisted portions 13*a* and 14*b* of the first and second beam portions 13 and 14, which makes it possible to prevent the twisted portions 13*a* and 14*b* of the first and second beam portions 13 and 14 from being plastically deformed.

Next, a description will be given of a contact element 401 according to a fourth embodiment of the present invention with reference to FIGS. 10 to 13. Component parts identical to those of the contact element according to the first and second embodiments are denoted by the same reference numerals, and detailed description thereof is omitted. The following description will be given of only different parts from those of the first and second embodiments.

The fourth embodiment has substantially the same basic arrangement as that of the second embodiment.

Figure 10:
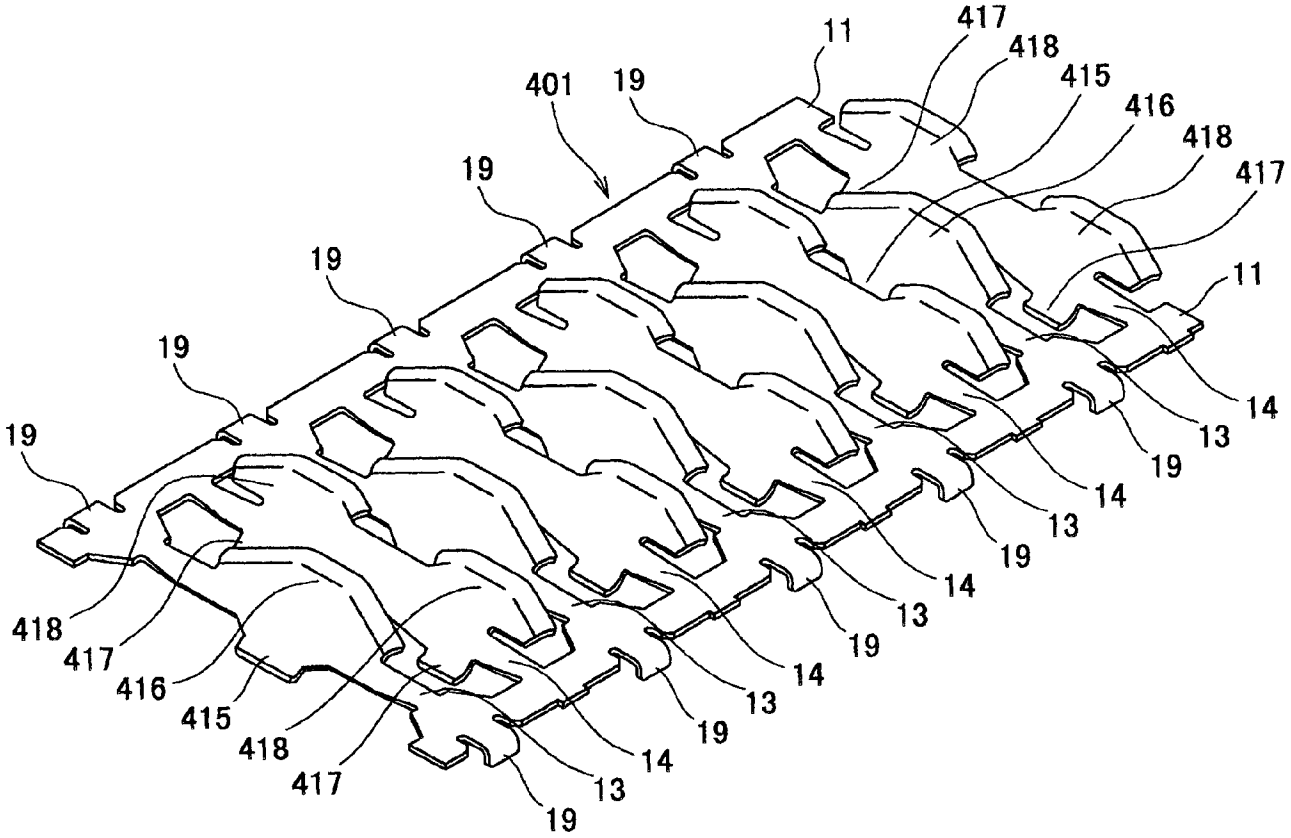
FIG. 10 is a perspective view of part of a contact element of a connector according to a fourth embodiment of the present invention.
Figure 11:
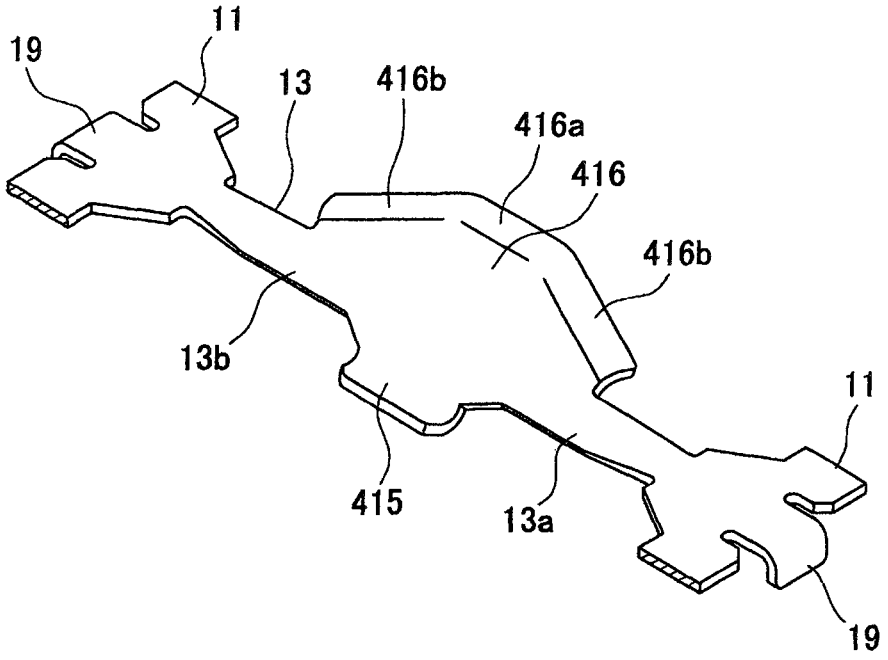
FIG. 11 is a perspective view of a first beam portion of the contact element shown in FIG. 10.

As shown in FIGS. 10 and 11, a first contact portion 415 and a second contact portion 416 of the contact element 401 are located on a central portion of the first beam portion 13, and front end portions of the first contact portion 415 and the second contact portion 416 are each arcuately bent. The second contact portion 416 includes a contact point portion 416*a*, and guiding portions 416*b* are formed on opposite sides of the contact point portion 416*a*.

Figure 12:
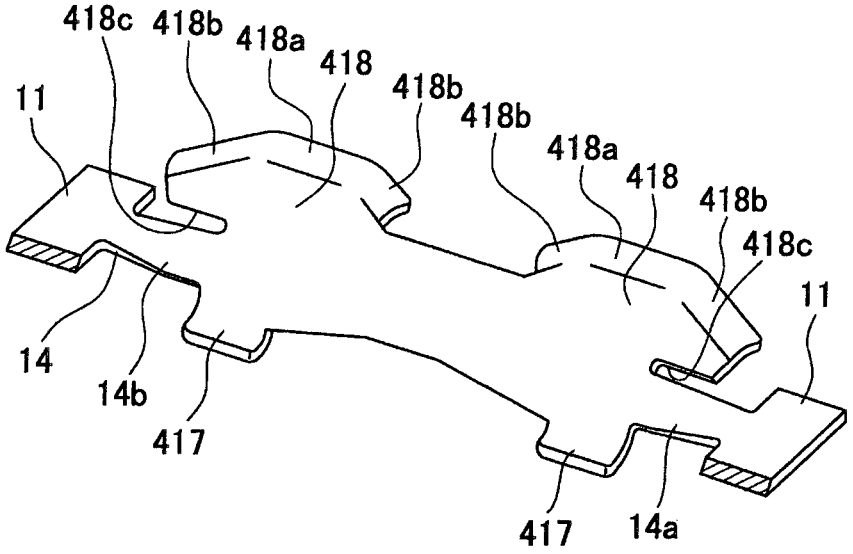
FIG. 12 is a perspective view of a second beam portion of the contact element shown in FIG. 10.

As shown in FIG. 12, third contact portions 417 and fourth contact portions 418 of the contact element 401 are located toward ends of the second beam portion 14, and front end portions of each third contact portion 417 and each fourth contact portion 418 are each arcuately bent. Each fourth contact portion 418 includes a contact point portion 418*a*, and guiding portions 418*b* are formed on opposite sides of the contact point 418*a*.

Figure 13:
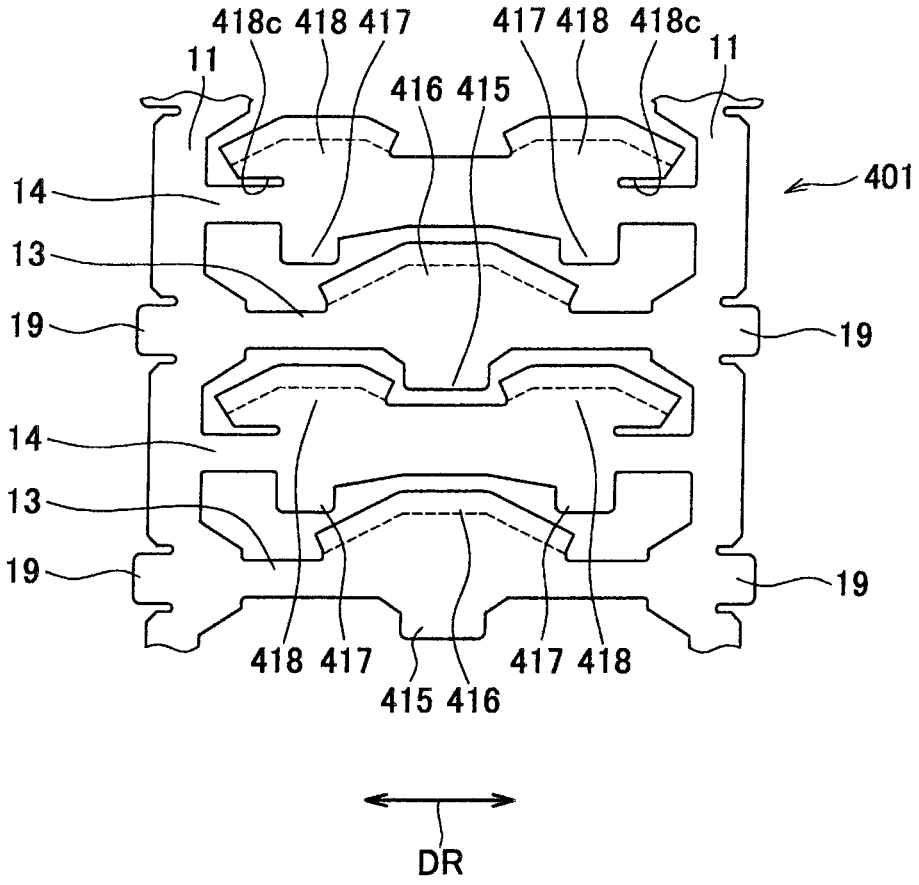
FIG. 13 is a plan view of the contact element when blanked.

Each fourth contact portion 418 is formed with a slit 418*c* (see FIGS. 12 and 13).

According to the fourth embodiment, it is possible to obtain the same advantageous effects as provided by the first and second embodiments, and it is possible to more easily insert the mating contact. Further, it is possible to prevent the twisted portions 14*a* and 14*b* of the second beam portion 14 from being plastically deformed.

Next, a description will be given of a connector according to a fifth embodiment of the present invention with reference to FIGS. 14, 15, and 16. Component parts identical to those of the connector according to the first embodiment are denoted by the same reference numerals, and detailed description thereof is omitted. The following description will be given of only different parts from those of the first embodiment.

Figure 14:
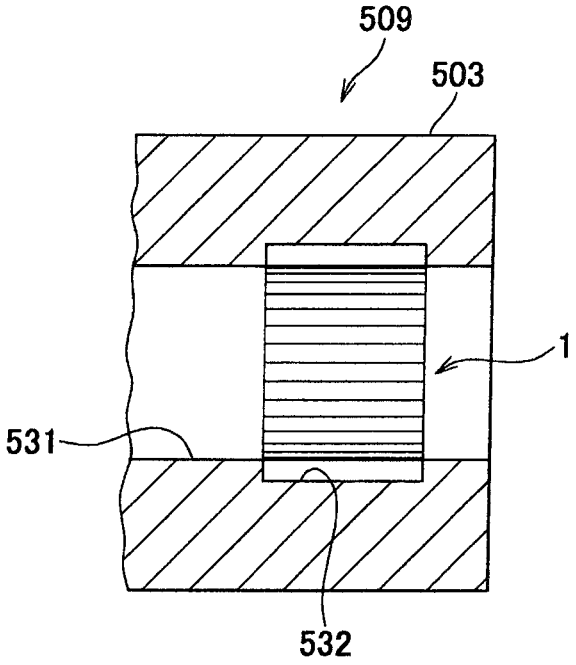
FIG. 14 is a cross-sectional view of a socket-type connector according to a fifth embodiment of the present invention.
Figure 15:
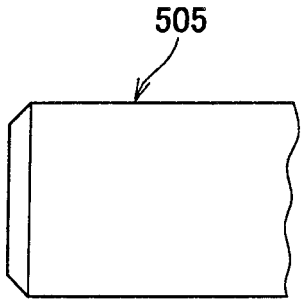
FIG. 15 is a side view of a mating contact which is inserted into a contact of the socket-type connector shown in FIG. 14.
Figure 16:
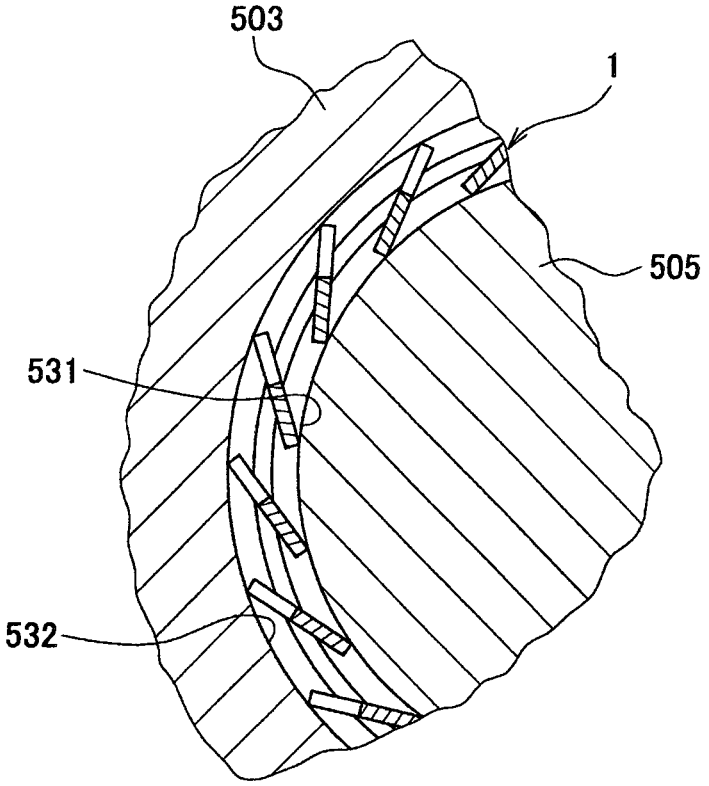
FIG. 16 is a partial cross-sectional view showing a state in which the mating contact shown in FIG. 15 is inserted into the contact of the socket-type connector shown in FIG. 14.

As shown in FIGS. 14, 15, and 16, the fifth embodiment is an application of the contact element 1 shown in FIG. 2 to a socket-type connector 509.

As shown in FIG. 14, the connector 509 comprises one socket-type contact 503 and one contact element 1.

As shown in FIG. 14, the contact 503 has a hollow cylindrical shape, and an inner space within the contact 503 forms a receiving portion 531. The receiving portion 531 receives a contact 505 (see FIG. 16). The contact 503 has a groove 532 formed in an inner peripheral surface thereof along a circumferential direction, for fitting the contact element 1 therein. The groove 532 is not a dovetail groove, and has a rectangular cross section.

The contact 505 which is a mating contact of the connector 509 is a pin-type contact (see FIG. 15).

To fit the contact element 1 in the groove 532 of the contact 503, first, the contact element 1 in a belt-like form is bent into a roll. An outer diameter of the contact element 1 at this time is larger than an inner diameter of a portion of the contact 503 where the groove 532 is formed.

Next, the outer diameter of the rolled contact element 1 is made smaller than the inner diameter of the receiving portion 531 of the contact 503, and the contact element 1 held in this state is fitted into the groove 532 through the receiving portion 531. The outer diameter of the contact element 1 fitted in the groove 532 is increased by the elastic force thereof, and is brought into close contact with a bottom surface of the groove 532. The outer diameter of the contact element 1 is larger than the inner diameter of the receiving portion 531, and hence the contact element 1 is prevented from being removed from the groove 532.

According to the fifth embodiment, it is possible to obtain the same advantageous effects as provided by the first embodiment.

Next, a description will be given of a connector according to a sixth embodiment of the present invention with reference to FIGS. 17 and 18. Component parts identical to those of the connector according to the first embodiment are denoted by the same reference numerals, and detailed description thereof is omitted. The following description will be given of only different parts from those of the first embodiment.

Figure 17:
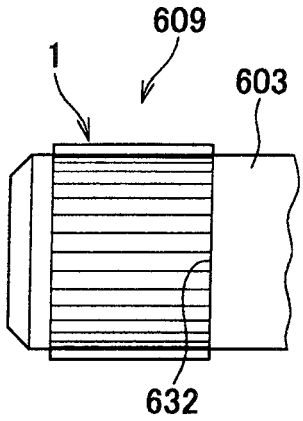
FIG. 17 is a side view of part of a pin-type connector according to a sixth embodiment of the present invention.
Figure 18:
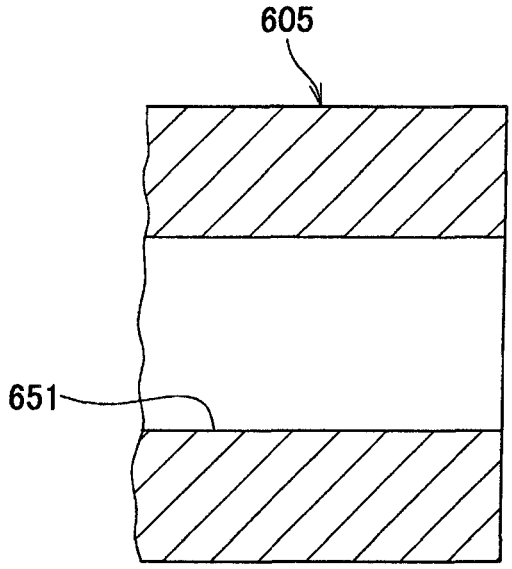
FIG. 18 is a cross-sectional view of part of a mating contact into which a contact of the pin-type connector shown in FIG. 17 is inserted.

As shown in FIGS. 17 and 18, the sixth embodiment is an application of the contact element 1 shown in FIG. 2 to a pin-type connector 609.

The connector 609 comprises a pin-type contact 603 and the contact element 1.

The contact 603 has a pin shape. The contact 603 has a groove 632 formed in an outer peripheral surface thereof, for fitting the contact element 1 therein. The groove 632 is not a dovetail groove, and has a rectangular cross section.

A contact 605 which is a mating contact of the connector 609 is a socket-type contact (see FIG. 18). The contact 605 has a receiving portion 651 for receiving the contact 603.

To fit the contact element 1 in the groove 632 of the contact 603, first, the belt-like contact element 1 is bent into a roll. An inner diameter of the contact element 1 at this time is smaller than an outer diameter of a portion of the contact 603 where the groove 632 is formed.

Next, the inner diameter of the rolled contact element 1 is made larger than the outer diameter of the contact 603, and the contact element 1 is fitted in the groove 632. The inner diameter of the contact element 1 set in the groove 632 is reduced by the elastic force thereof, and is brought into close contact with a bottom surface of the groove 632. The inner diameter of the contact element 1 is smaller than the outer diameter of the contact 603, and hence the contact element 1 is prevented from being removed from the groove 632.

According to the sixth embodiment, it is possible to obtain the same advantageous effects as provided by the first embodiment.

Next, a description will be given of a contact element according to a seventh embodiment of the present invention with reference to FIGS. 19 and 20. Component parts identical to those of the contact element according to the first embodiment are denoted by the same reference numerals, and detailed description thereof is omitted. The following description will be given of only different parts from those of the first embodiment.

Although in the first embodiment, the first beam portion 13 and the second beam portion 14 of respective two types are provided as the beam portions, in the seventh embodiment, a first beam portion 713, a second beam portion 714, and a third beam portion 721 of respective three types are provided as the beam portions.

A first contact portion 715 which is brought into contact with the contact 3 (see FIG. 1) is continuous with the first beam portion 713. The first contact portion 715 is at a location displaced from the center of the first beam portion 713 toward one of the linking portions 11.

A second contact portion 716 which is brought into contact with the contact 5 (see FIG. 1) is continuous with the first beam portion 713. The second contact portion 716 is at a location displaced from the center of the first beam portion 713 toward the one of the linking portions 11.

The first contact portion 715 protrudes from the first beam portion 713 in the first direction D1 (see FIG. 20) parallel to the arranging direction DP of the first, second, and third beam portions 713, 714, and 721.

The second contact portion 716 protrudes from the first beam portion 713 in the second direction D2 (see FIG. 20) opposite to the first direction D1.

A third contact portion 717 which is brought into contact with the contact 3 is continuous with the second beam portion 714. The third contact portion 717 is located on a central portion of the second beam portion 714.

A fourth contact portion 718 which is brought into contact with the contact 5 is continuous with the second beam portion 714. The fourth contact portion 718 is located on the central portion of the second beam portion 714.

Figure 20:
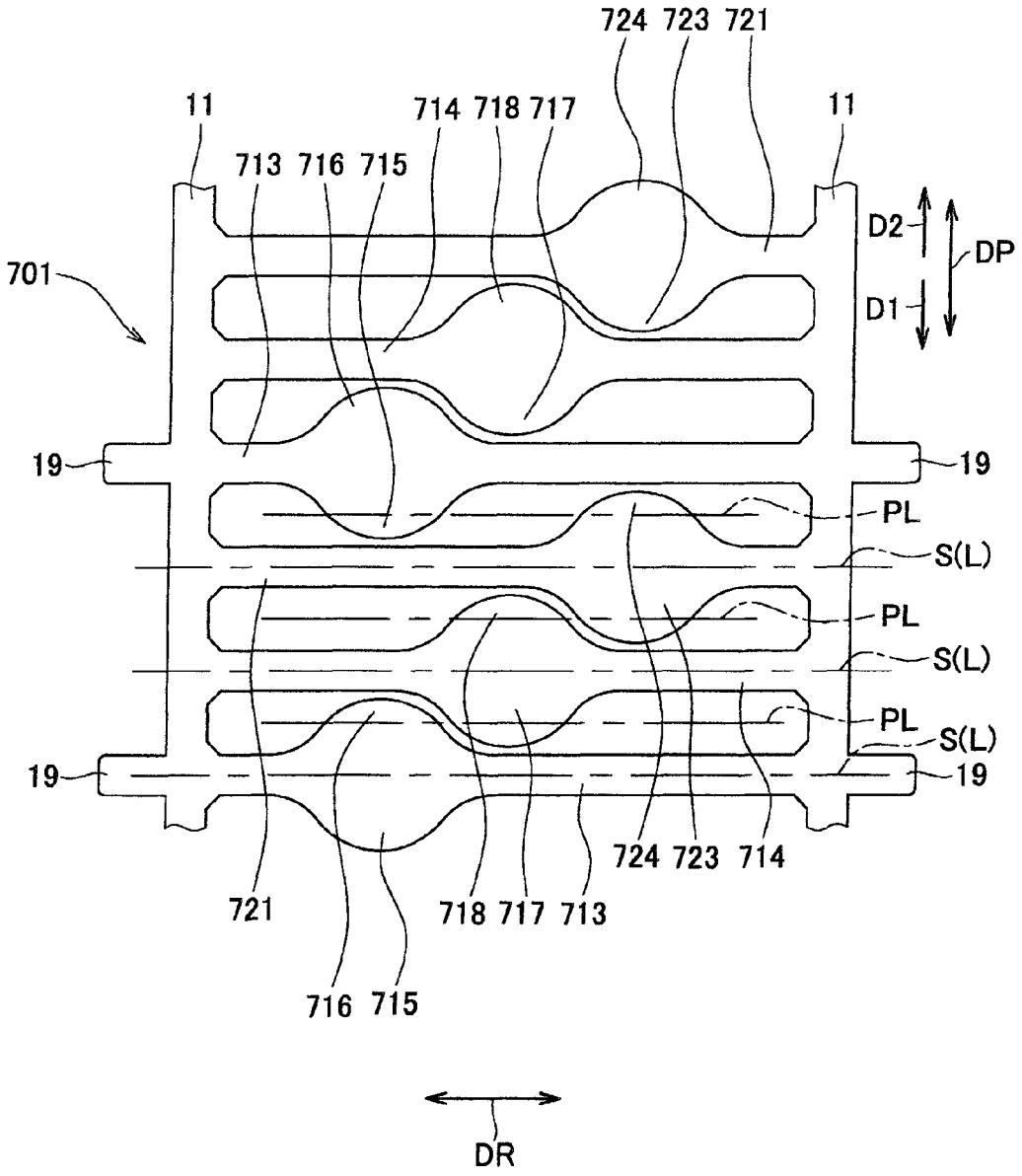
FIG. 20 is a plan view of the contact element when blanked.

The third contact portion 717 protrudes from the second beam portion 714 in the first direction D1 (see FIG. 20).

The fourth contact portion 718 protrudes from the second beam portion 714 in the second direction D2 (see FIG. 20).

A fifth contact portion 723 which is brought into contact with the contact 3 is continuous with the third beam portion 721. The fifth contact portion 723 is at a location displaced from the center of the third beam portion 721 toward the other of the linking portions 11.

A sixth contact portion 724 which is brought into contact with the contact 5 is continuous with the third beam portion 721. The sixth contact portion 724 is at a location displaced from the center of the first beam portion 713 toward the other of the linking portions 11.

The fifth contact portion 723 protrudes from the third beam portion 721 in the first direction D1 (see FIG. 20).

The sixth contact portion 724 protrudes from the third beam portion 721 in the second direction D2 (see FIG. 20).

Figure 19:
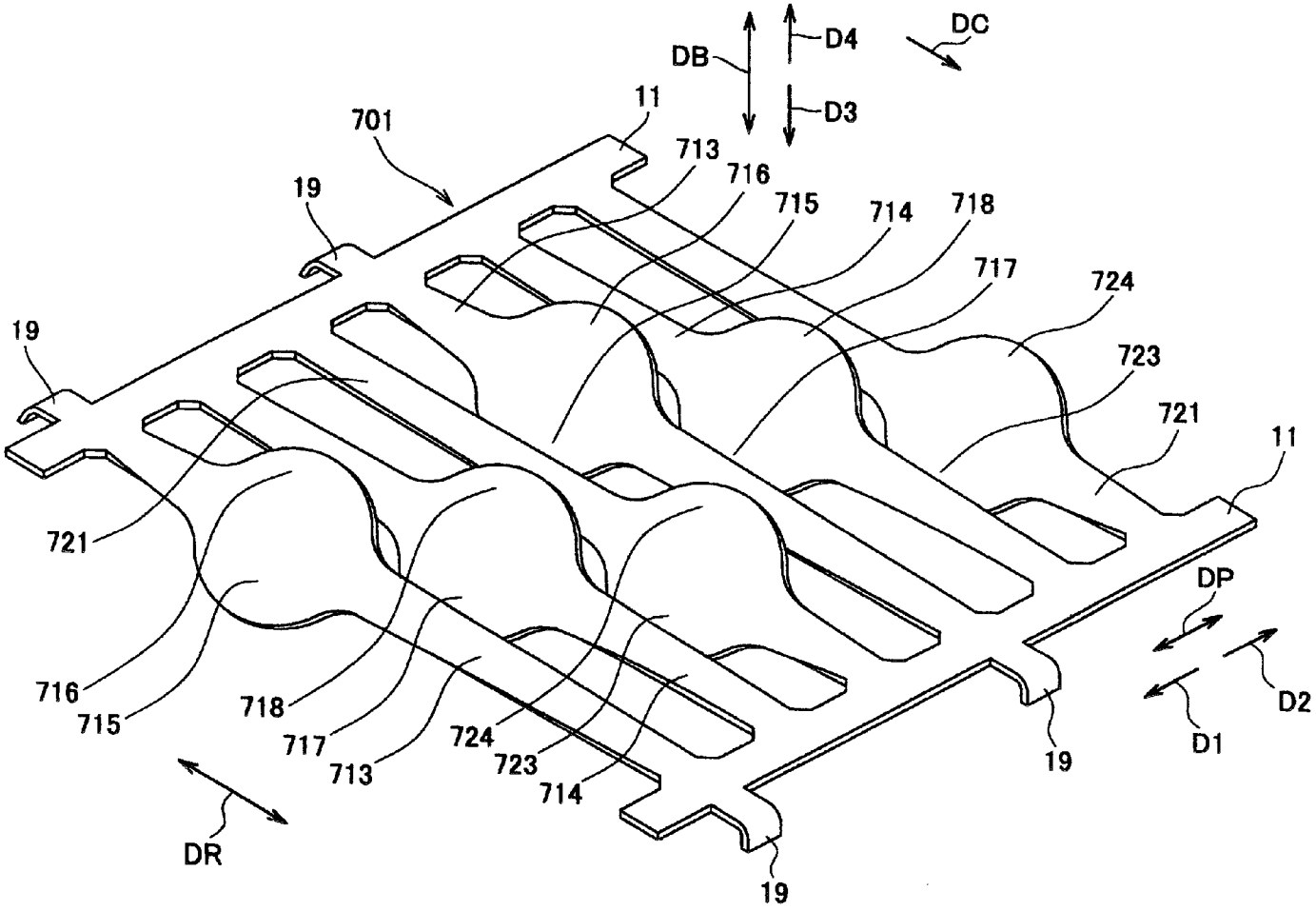
FIG. 19 is a perspective view of part of a contact element of a connector according to a seventh embodiment of the present invention.

As shown in FIG. 19, each of the first beam portions 713 is twisted around the central axis S (see FIG. 20) parallel to the longitudinal direction L thereof, whereby the first contact portion 715 protrudes in the third direction D3 parallel to the thickness direction DB of the linking portion 11, and the second contact portion 716 protrudes in the fourth direction D4 opposite to the third direction D3.

As shown in FIG. 19, each of the second beam portions 714 is twisted around the central axis S (see FIG. 20) parallel to the longitudinal direction L thereof, whereby the third contact portion 717 protrudes in the third direction D3, and the fourth contact portion 718 protrudes in the fourth direction D4.

As shown in FIG. 19, each of the third beam portions 721 is twisted around the central axis S (see FIG. 20) parallel to the longitudinal direction L thereof, whereby the fifth contact portion 723 protrudes in the third direction D3, and the sixth contact portion 724 protrudes in the fourth direction D4. The central axis S of each of the first, second, and third beam portions 713, 714, and 721 is parallel to the orthogonal direction DR, referred to hereinafter.

As shown in FIG. 19, the second contact portion 716, the fourth contact portion 718, and the sixth contact portion 724 are displaced from one another in the orthogonal direction DR which is orthogonal to the arranging direction DP of the first, second, and third beam portions 713, 714, and 721 and the thickness direction DB of the linking portion 11.

As shown in FIG. 20, the first contact portion 715 and the second contact portion 716 are symmetric with respect to the central axis S of the first beam portion 713. Similarly, the third contact portion 717 and the fourth contact portion 718 are symmetric with respect to the central axis S of the second beam portion 714. Similarly, the fifth contact portion 723 and the sixth contact portion 724 are symmetric with respect to the central axis S of the third beam portion 721.

As shown in FIG. 20, when a metal plate has been blanked, the first contact portion 715 and the sixth contact portion 724 of the fourth beam portion 721 adjacent to this first contact portion 715 are side by side along the direction PL parallel to the longitudinal direction L, the second contact portion 716 and the third contact portion 717 of the second beam portion 714 adjacent to this second contact portion 716 are side by side along the direction PL parallel to the longitudinal direction L, and the fourth contact portion 718 and the fifth contact portion 723 of the third beam portion 721 adjacent to this fourth contact portion 718 are side by side along the direction PL parallel to the longitudinal direction L.

The first contact portion 715 and the second contact portion 716 which are continuous with one first beam portion 713 are each provided in number of one, the third contact portion 717 and the fourth contact portion 718 which are continuous with one second beam portion 714 are each provided in number of one, and the fifth contact portion 723 and the sixth contact portion 724 which are continuous with one third beam portion 721 are each provided in number of one.

To form the contact element, denoted by reference numeral 701, first, as shown in FIG. 20, a metal plate is blanked.

Next, the first beam portions 713, the second beam portions 714, and the third beam portions 721 are each twisted around the central axis S.

Finally, the held portions 19 are each bent into a substantially L shape.

By the above-described steps, the contact element 701 is formed.

According to the seventh embodiment, it is possible to obtain the same advantageous effects as provided by the first embodiment.

Next, a description will be given of a contact element 801 according to an eighth embodiment of the present invention with reference to FIGS. 21 and 22. Component parts identical to those of the contact element according to the first embodiment are denoted by the same reference numerals, and detailed description thereof is omitted. The following description will be given of only different parts from those of the first embodiment.

The contact element 801 according to the eighth embodiment has the same basic structure as the contact element according to the seventh embodiment.

Figure 21:
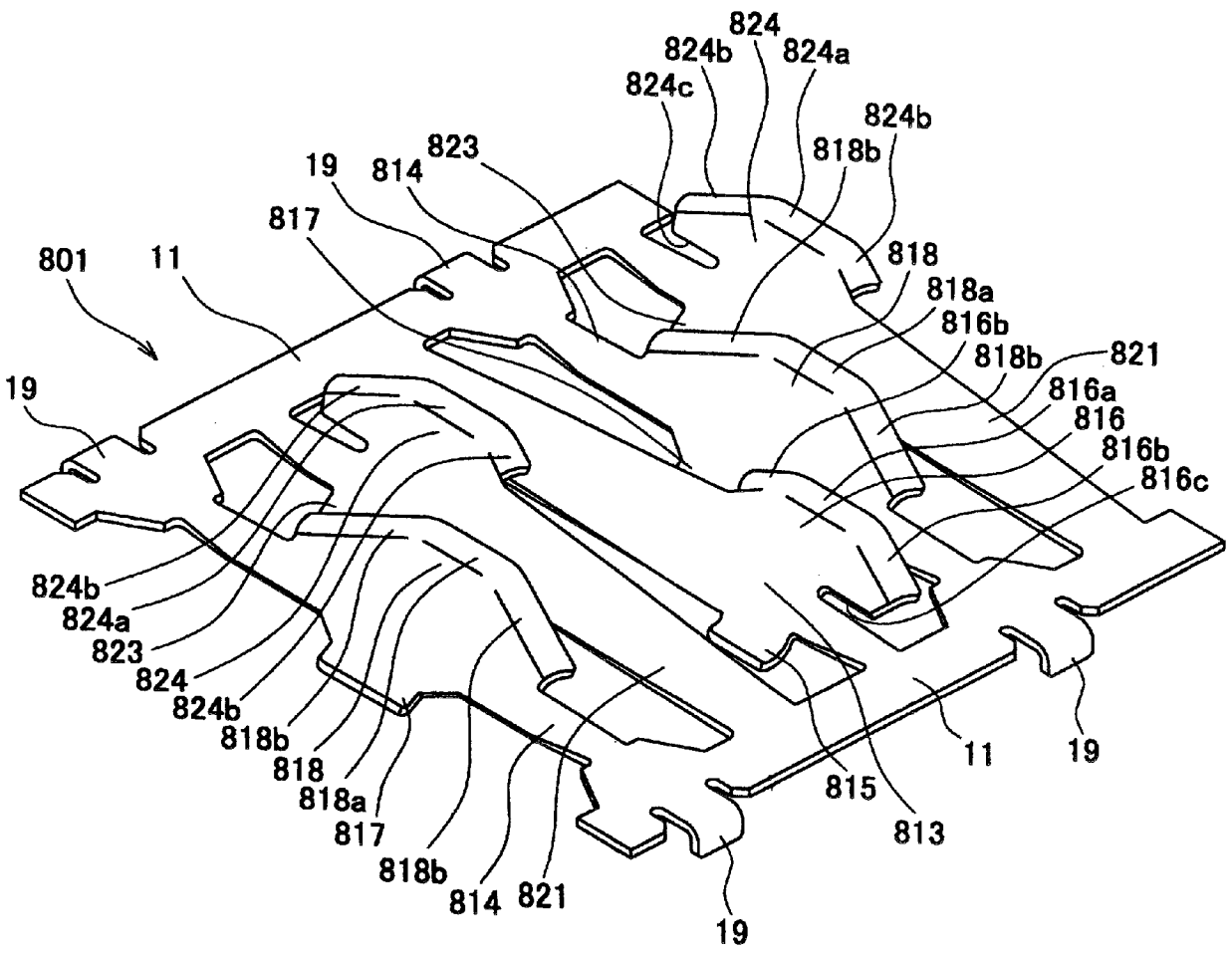
FIG. 21 is a perspective view of part of a contact element of a connector according to an eighth embodiment of the present invention.
Figure 22:
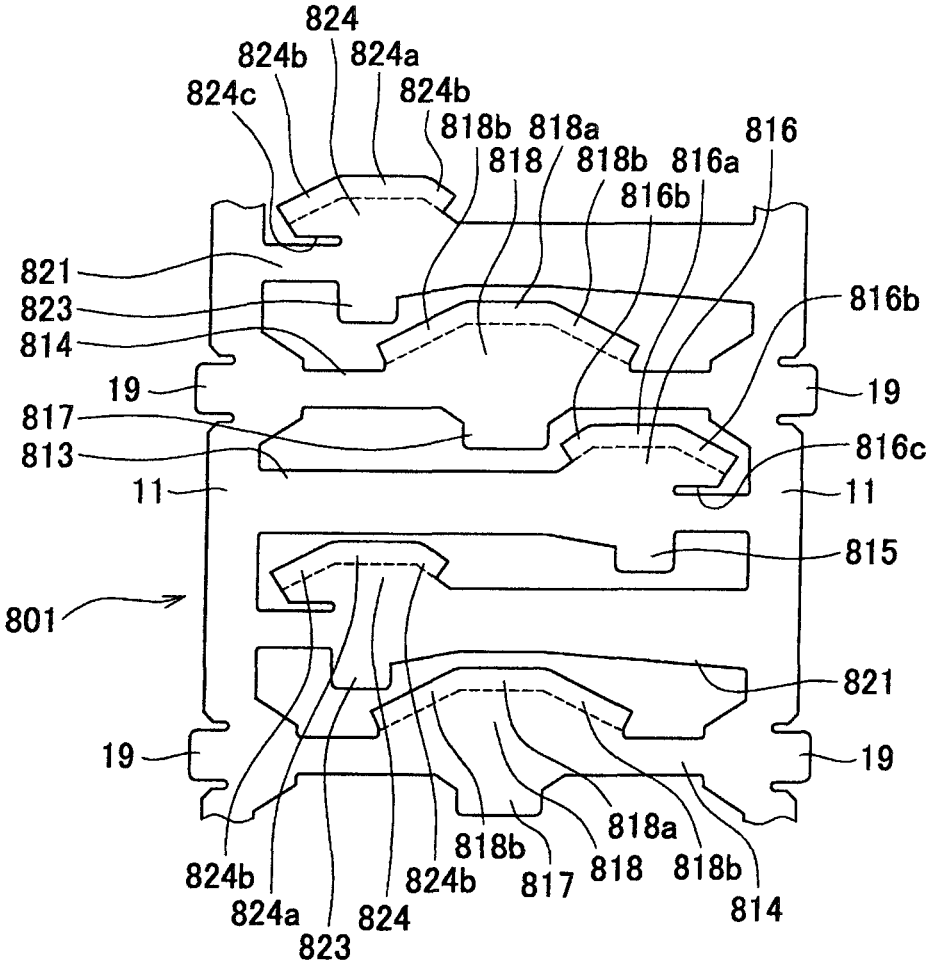
FIG. 22 is a plan view of the contact element when blanked.
Figure 23:
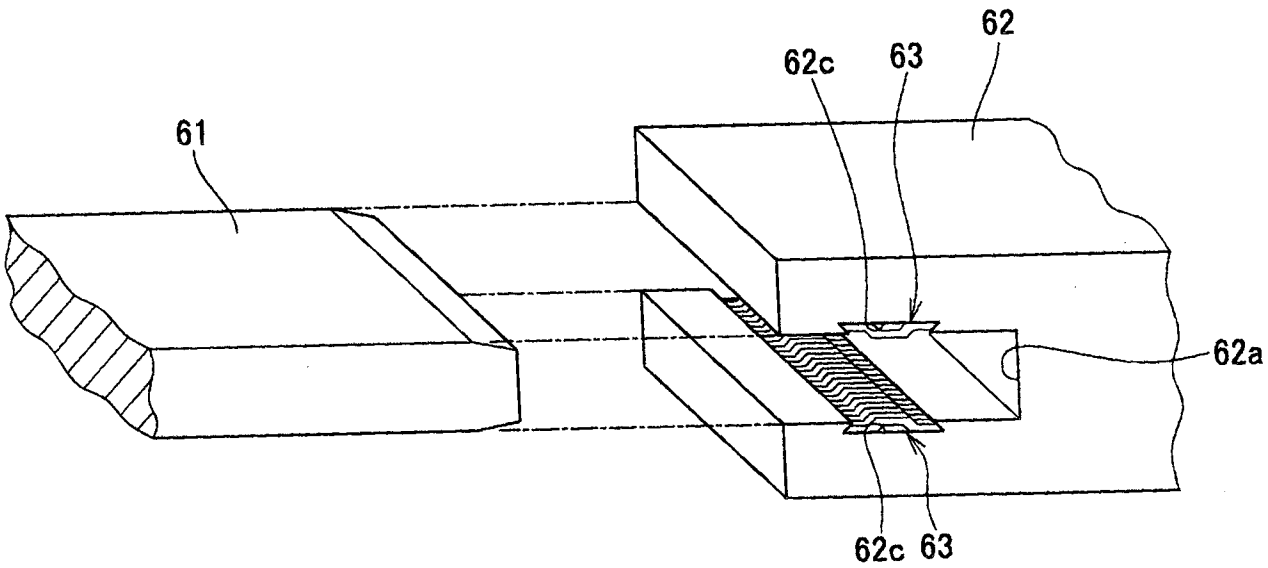
FIG. 23 PRIOR ART
FIG. 23 is a perspective view showing a state before a mating contact is inserted into a contact of a conventional connector.
Figure 24:
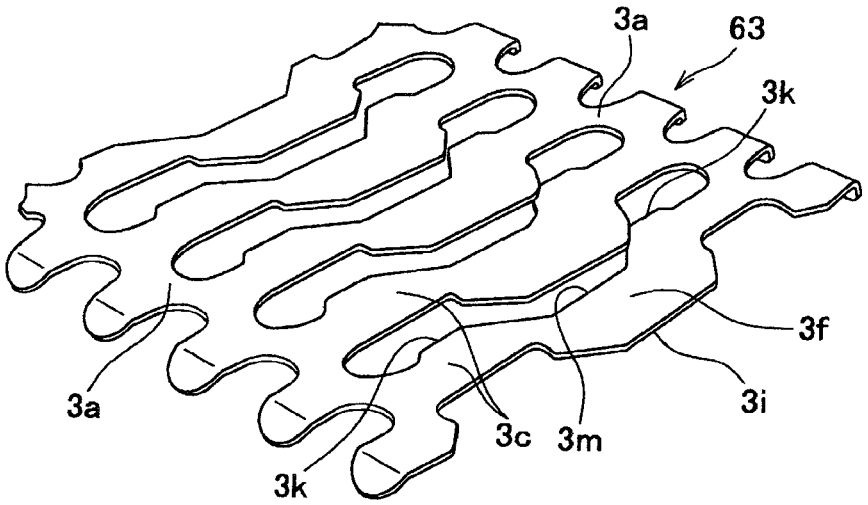
FIG.24 PRIOR ART
FIG. 24 is a perspective view of a contact element of the connector shown in FIG. 23.

As shown in FIG. 21, a first contact portion 815 and a second contact portion 816 of the contact element 801 are located toward an end of a first beam portion 813, and front ends of the first contact portion 815 and the second contact portion 816 are each arcuately bent. The second contact portion 816 includes a contact point portion 816*a*, and guiding portions 816*b* are formed on opposite sides of the contact point portion 816*a*. One of the guiding portions 816*b* gradually slopes toward the one of the linking portions 11, and the other of the guiding portions 816*b* gradually slopes toward the other of the linking portions 11.

The second contact portion 816 is formed with a slit 816*c*.

As shown in FIG. 21, a third contact portion 817 and a fourth contact portion 818 of the contact element 801 are located on a central portion of the second beam portion 814, and front end portions of the third contact portion 817 and the fourth contact portion 818 are each arcuately bent. The fourth contact portion 818 includes a contact point portion 818*a*, and guiding portions 818*b* are formed on opposite sides of the contact point portion 818*a*. One of the guiding portions 818*b* gradually slopes toward the one of the linking portions 11, and the other of the guiding portions 818*b* gradually slopes toward the other of the linking portions 11.

As shown in FIG. 21, a fifth contact portion 823 and a sixth contact portion 824 of the contact element 801 are located toward an end of a third beam portion 821, and front ends of the fifth contact portion 823 and the sixth contact portion 824 are each arcuately bent. The sixth contact portion 824 includes a contact point portion 824*a*, and guiding portions 824*b* are formed on opposite sides of the contact point portion 824*a*. One of the guiding portions 824*b* gradually slopes toward the one of the linking portions 11, and the other of the guiding portions 824*b* gradually slopes toward the other of the linking portions 11.

The sixth contact portion 824 is formed with a slit 824*c*.

According to the eighth embodiment, it is possible to obtain the same advantageous effects as provided by the third embodiment.

Note that although in the above-described embodiments, the front end portions of the first contact portions 315, 415, and 815, the second contact portions 316, 3316, 416, and 816, the third contact portions 317, 417, and 817, the fourth contact portions 318, 418, and 818, the fifth contact portion 823, and the sixth contact portion 824 are each arcuately bent, it is not necessarily required to arcuately bend these components.

Further, although in the above-described embodiments, the contact element 1 is provided with two linking portions 11, three or more linking portions 11 may be employed, and each of the beam portions 13, 713, 813, 14, 714, 721, 814, and 821 may be provided in plurality to extend in a manner bridging between the three or more linking portions 11.

A connector according to an embodiment other than the above-described embodiments comprises a plate-shaped contact formed with a dovetail groove in an upper surface thereof, and the above-described contact element 1 which is inserted into the dovetail groove of the plate-shaped contact. A mating contact of this connector is a plate-shaped mating contact. In this embodiment, the mating contact is superposed on the upper surface of the contact of the connector, and the contact of the connector and the mating contact are connected with bolts and nuts. The contact of the connector and the mating contact connected with the bolts and the nuts are electrically connected with each other via the contact element 1.

Further, a connector according to an embodiment other than the above-described embodiments has an a rear end of the contact 3 held by a housing, not shown, formed of an insulating material.

Although in the above-described fifth and sixth embodiments, the contact element 1 according to the first embodiment is employed as the contact element of the connectors 509 and 609, any of the contact elements 201, 301, 401, and 3301 according to the above-described second to fourth embodiments and variation, and the contact elements 701 and 801 according to the seventh and eighth embodiments may be employed in place of the contact element 1.

Further, although in the above-described embodiments and variation, the longitudinal direction L (central axis S) of the first, second, and third beam portions 13, 713, 813, 14, 714, 814, 721, and 821 is parallel to the orthogonal direction DR, the longitudinal direction L (central axis S) may be tilted with respect to the orthogonal direction DR.

DESCRIPTION OF REFERENCE NUMERALS

1, 201, 301, 3301, 401, 701, 801: contact element; 11: linking portion; 13, 713, 813: first beam portion, 13*a*, 13*b*: twisted portion; 14, 714, 814: second beam portion; 721, 821: third beam portion; 14*a*, 14*b*: twisted portion; 15, 215, 315, 415, 715, 815: first contact portion; 16, 216, 316, 3316, 416, 716, 816: second contact portion; 17, 217, 317, 417, 717, 817: third contact portion; 18, 218, 318, 3318, 418, 718, 818: fourth contact portion; 723, 823: fifth contact portion; 724, 824: sixth contact portion; 19: held portion; 3, 503, 603: contact; 31, 531, 651: receiving portion; 32 dovetail groove; 532, 632: groove; 5, 505, 605: contact (mating contact); 9,

509, 609: connector; 316*a*, 318*a*, 416*a*, 418*a*, 816*a*, 818*a*, 824*a*: contact point portion; 316*b*, 318*b*, 416*b*, 418*b*, 816*b*, 818*b*, 824*b*: guiding portion; 3316*c*, 3318*c*, 418*c*, 816*c*, 818*c*, 824*c*: slit; a: distance; DB: thickness direction; DC: fitting direction; DP: arranging direction; DR: orthogonal direction; D1: first direction; D2: second direction; D3: third direction; D4: fourth direction; H: height direction; L: longitudinal direction; S: central axis; W: width direction; PL: direction parallel to longitudinal direction

The invention claimed is:

1. A contact element that is formed by pressworking a metal plate, and is configured to be mounted on a contact, the contact element comprising:

a plurality of linking portions that extend parallel to each other with a fixed spacing therebetween;

first and second beam portions that extend in a manner bridging between said linking portions, wherein the first and second beam portions are arranged at a predetermined pitch in an alternating manner;

a first contact portion that is continuous with a first beam portion, and is brought into contact with the contact;

a second contact portion that is continuous with said first beam portion, and is brought into contact with a mating contact to which the contact is connectable;

a third contact portion that is continuous with a second beam portion, and is brought into contact with the contact; and a fourth contact portion that is continuous with said second beam portion, and is brought into contact with the mating contact, wherein said first and third contact portions protrude in a first direction parallel to an arranging direction of said first and second beam portions, wherein said second and fourth contact portions protrude in a second direction opposite to the first direction, wherein said first and second beam portions are twisted, whereby said first and third contact portions protrude in a third direction parallel to a thickness direction of said linking portions, and said second and fourth contact portions protrude in a fourth direction opposite to the third direction, wherein said second and fourth contact portions are displaced from each other in an orthogonal direction orthogonal to the arranging direction and the thickness direction, wherein when the metal plate is blanked, said first and fourth contact portions are displaced from each other in a longitudinal direction of said first and second beam portions, wherein when the metal plate is blanked, said second and third contact portions are displaced from each other in the longitudinal direction of said first and second beam portions, and wherein a pitch of said first and second beam portions is less than a spacing between an end of said first contact portion and an end of said second contact portion, and less than a spacing between an end of said third contact portion and an end of said fourth contact portion.

2. The contact element as claimed in claim 1, wherein when the metal plate is blanked, said first and fourth contact portions are side by side along a direction parallel to the longitudinal direction of said first and second beam portions, and wherein when the metal plate is blanked, said second and third contact portions are side by side along the direction parallel to the longitudinal direction of said first and second beam portions.

3. The contact element as claimed in claim 1, wherein one of each of said first contact portion and said second contact portion, which are continuous with said first beam portion, is provided, and wherein one of each of said third contact portion and said fourth contact portion, which are continuous with said second beam portion, is provided.

4. The contact element as claimed in claim 2, wherein one of each of said first contact portion and said second contact portion, which are continuous with said first beam portion, is provided, and wherein one of each of said third contact portion and said fourth contact portion, which are continuous with said second beam portion, is provided.

5. The contact element as claimed in claim 1, wherein one of each of said first contact portion and said second contact portion, which are continuous with said first beam portion, is provided, wherein two of each of said third contact portion and said fourth contact portion, which are continuous with said second beam portion, is provided, wherein said two fourth contact portions are located on opposite sides of said first contact portion, and wherein said two third contact portions are located on opposite sides of said second contact portion.

6. The contact element as claimed in claim 2, wherein one of each of said first contact portion and said second contact portion, which are continuous with said first beam portion, is provided, wherein two of each of said third contact portion and said fourth contact portion, which are continuous with said second beam portion, is provided, wherein said two fourth contact portions are located on opposite sides of said first contact portion, and wherein said two third contact portions are located on opposite sides of said second contact portion.

7. The contact element as claimed in claim 3, wherein said second and fourth contact portions each have a slit formed in a rear end portion thereof, which extends in the longitudinal direction of said first and second beam portions.

8. The contact element as claimed in claim 4, wherein said second and fourth contact portions each have a slit formed in a rear end portion thereof, which extends in the longitudinal direction of said first and second beam portions.

9. The contact element as claimed in claim 5, wherein each of said two fourth contact portions has a slit formed in a rear end portion thereof, which extends in the longitudinal direction of said first and second beam portions.

10. The contact element as claimed in claim 6, wherein each of said two fourth contact portions has a slit formed in a rear end portion thereof, which extends in the longitudinal direction of said first and second beam portions.

11. The contact element as claimed in claim 1, wherein front end portions of said first to fourth contact portions are each arcuately bent.

12. A contact element that is formed by pressworking a metal plate, and is configured to be mounted on a contact, the contact element comprising:

a plurality of linking portions that extend parallel to each other with a fixed spacing therebetween;

first, second, and third beam portions that extend in a manner bridging between said linking portions, wherein the first, second and third beam portions are arranged at a predetermined pitch and in a predetermined order;

a first contact portion that is continuous with a first beam portion, and is brought into contact with the contact;

a second contact portion that is continuous with said first beam portion, and is brought into contact with a mating contact to which the contact is connectable;

a third contact portion that is continuous with a second beam portion, and is brought into contact with the contact;

a fourth contact portion that is continuous with said second beam portion, and is brought into contact with the mating contact;

a fifth contact portion which is continuous with a third beam portion, and is brought into contact with the contact; and a sixth contact portion which is continuous with said third beam portion, and is brought into contact with the mating contact, wherein said first, third, and fifth contact portions protrude in a first direction parallel to an arranging direction of said first, second, and third beam portions, wherein said second, fourth, and sixth contact portions protrude in a second direction opposite to the first direction, wherein said first, second, and third beam portions are twisted, whereby said first, third, and fifth contact portions protrude in a third direction parallel to a thickness direction of said linking portions, and said second, fourth, and sixth contact portions protrude in a fourth direction opposite to the third direction, wherein said second, fourth, and sixth contact portions are displaced from each other in an orthogonal direction orthogonal to the arranging direction and the thickness direction, wherein when the metal plate is blanked, said first, third, and fifth contact portions are displaced from each other in a longitudinal direction of said first, second, and third beam portions, wherein when the metal plate is blanked, said second, fourth, sixth contact portions are displaced from each other in the longitudinal direction of said first, second, and third beam portions, and wherein a pitch of two adjacent ones of said first, second and third beam portions is less than a spacing between an end of said first contact portion and an end of said second contact portion, less than a spacing between an end of said third contact portion and an end of said fourth contact portion, and less than a spacing between an end of said fifth contact portion and an end of said sixth contact portion.

13. The contact element as claimed in claim 12, wherein when the metal plate is blanked:

said first and sixth contact portions are side by side along a direction parallel to the longitudinal direction of said first, second and third beam portions, said second and third contact portions are side by side along the direction parallel to the longitudinal direction of said first, second and third beam portions, and said fourth and fifth contact portions are side by side along the direction parallel to the longitudinal direction of said first, second and third beam portions.

14. The contact element as claimed in claim 12, wherein one of each of said first contact portion and said second contact portion, which are continuous with said first beam portion, is provided, wherein one of each of said third contact portion and said fourth contact portion, which are continuous with said second beam portion, is provided, and wherein one of each of said fifth contact portion and said sixth contact portion, which are continuous with said third beam portion, is provided.

15. The contact element as claimed in claim 13, wherein one of each of said first contact portion and said second contact portion, which are continuous with said first beam portion, is provided, wherein one of each of said third contact portion and said fourth contact portion, which are continuous with said second beam portion, is provided, and wherein one of each of said fifth contact portion and said sixth contact portion, which are continuous with said third beam portion, is provided.

16. The contact element as claimed in claim 12, wherein said second and sixth contact portions each have a slit formed in a rear end portion thereof, which extends in the longitudinal direction of said first, second and third beam portions.

17. The contact element as claimed in claim 13, wherein said second and sixth contact portions each have a slit formed in a rear end portion thereof, which extends in the longitudinal direction of said first, second and third beam portions.

18. The contact element as claimed in claim 14, wherein said second and sixth contact portions each have a slit formed in a rear end portion thereof, which extends in the longitudinal direction of said first, second and third beam portions.

19. The contact element as claimed in claim 12, wherein front end portions of said first to sixth contact portions are each arcuately bent.

20. A connector comprising a contact element as claimed in claim 1, and the contact on which the contact element is mounted.

21. A connector comprising a contact element as claimed in claim 12, and the contact on which the contact element is mounted.

* * * * *